US009970231B2

(12) United States Patent
Header et al.

(10) Patent No.: US 9,970,231 B2
(45) **Date of Patent: *May 15, 2018**

(54) QUICK RELEASE CLADDING SYSTEM FOR FENESTRATION FRAMES

(71) Applicant: Gregory Header, Pine Grove, PA (US)

(72) Inventors: Gregory Header, Richland, PA (US); Anton Vassilev, Lebanon, PA (US)

(73) Assignee: Gregory Header, Pine Grove, PA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/431,232

(22) Filed: Feb. 13, 2017

(65) Prior Publication Data

US 2017/0152699 A1 Jun. 1, 2017

Related U.S. Application Data

(63) Continuation of application No. 14/487,067, filed on Sep. 15, 2014, now Pat. No. 9,598,892.

(51) Int. Cl.

| | |
|---|---|
| ***E06B 3/30*** | (2006.01) |
| ***E04F 19/02*** | (2006.01) |
| ***E06B 1/34*** | (2006.01) |

(52) U.S. Cl.

CPC ..... *E06B 3/303* (2013.01); *E04F 19/02* (2013.01); *E06B 1/34* (2013.01)

(58) Field of Classification Search

CPC ..... E06B 1/04; E06B 1/06; E06B 1/08; E06B 1/34; E06B 1/342; E06B 1/40; E06B 1/60; E06B 1/56; E06B 1/605; E06B 1/6023; E06B 3/9632; E06B 3/964; E06B 3/9647; E06B 3/968; E06B 3/9684; E06B 3/988; E04B 2/88; E04B 2/96; E04B 2/965; E04B 2/967; E04F 19/02; E04F 19/0459; E04F 19/0468; E04F 19/0472; E04F 19/0481; E04F 19/0495

See application file for complete search history.

(56) References Cited

U.S. PATENT DOCUMENTS

| | | | |
|---|---|---|---|
| 2,346,264 | A | 4/1944 | Marshall |
| 3,161,926 | A | 12/1964 | Schaub |
| 3,593,473 | A | 7/1971 | King |

(Continued)

FOREIGN PATENT DOCUMENTS

| | | | |
|---|---|---|---|
| AU | 641250 | B2 | 1/1992 |
| CA | 1315603 | C | 4/1993 |

(Continued)

*Primary Examiner* — Jessica L Laux

(74) *Attorney, Agent, or Firm* — Stone Creek Services LLC; Alan M Flum

(57) ABSTRACT

Disclosed is quick-release removable cladding for interior fenestration frames, such as the interior frames of doors, window, skylights, or curtain walls. The cladding is held flush against the frame by a pair of brackets or alternatively by a bracket attached to frame and a shaped cavity within the cladding. In one aspect, the pair of brackets can be shaped and arranged so that when engaged, a downward force on the cladding causes the cladding to move flush against the frame. In another aspect, the cladding can be held securely in place to the frame by a keeper bar. The keeper bar can be configured to prevent upward movement of the cladding against the frame.

10 Claims, 22 Drawing Sheets

(56) References Cited

U.S. PATENT DOCUMENTS

| | | | | |
|---|---|---|---|---|
| 3,601,946 | A * | 8/1971 | Rothemund | E04B 2/967 52/235 |
| 4,565,041 | A | 1/1986 | Webdt | |
| 4,586,306 | A | 5/1986 | Webb | |
| 4,621,471 | A * | 11/1986 | Kuhr | E04B 2/82 52/242 |
| 4,694,612 | A | 9/1987 | Pruden et al. | |
| 4,890,435 | A | 1/1990 | Wilkening et al. | |
| 4,967,525 | A | 11/1990 | Koester | |
| 4,982,530 | A | 1/1991 | Palmer | |
| 5,081,793 | A | 1/1992 | Mauro | |
| 5,224,610 | A | 7/1993 | Veaezy | |
| 5,253,459 | A * | 10/1993 | Parinas | E04B 2/96 52/204.591 |
| 5,481,839 | A | 1/1996 | Lang et al. | |
| 5,839,236 | A | 11/1998 | Frey | |
| 6,141,923 | A | 11/2000 | Habicht et al. | |
| 6,155,010 | A | 12/2000 | Becken et al. | |
| 6,276,101 | B1 | 8/2001 | Schiedegger et al. | |
| 6,463,707 | B1 | 10/2002 | Schiedigger et al. | |
| 6,745,523 | B2 | 6/2004 | Petta | |
| D621,075 | S | 8/2010 | Haeussler | |
| 8,359,795 | B2 | 1/2013 | Beland | |
| 8,578,671 | B2 | 11/2013 | Labrecque et al. | |
| 8,631,619 | B2 | 1/2014 | Clayton et al. | |
| 8,769,901 | B2 | 7/2014 | Todd et al. | |
| 2002/0112423 | A1 | 8/2002 | Schiedegger et al. | |
| 2003/0145538 | A1* | 8/2003 | Kerscher | E06B 1/34 52/212 |
| 2006/0207197 | A1 | 9/2006 | Anderson | |
| 2008/0178541 | A1* | 7/2008 | Kerscher | E06B 1/34 52/204.1 |
| 2009/0064609 | A1 | 3/2009 | Ouyang et al. | |
| 2012/0233944 | A1 | 9/2012 | Reifer | |
| 2012/0241574 | A1 | 9/2012 | Uota et al. | |
| 2012/0272605 | A1 | 11/2012 | Huang | |
| 2012/0291391 | A1 | 11/2012 | MacDonald | |
| 2013/0180189 | A1 | 7/2013 | Reifer | |
| 2013/0312352 | A1 | 11/2013 | Gale | |
| 2013/0333321 | A1 | 12/2013 | Dollerup et al. | |
| 2014/0215939 | A1 | 8/2014 | Gosling et al. | |
| 2015/0197979 | A1 | 7/2015 | Hawk et al. | |
| 2015/0284951 | A1 | 10/2015 | Frederick | |

FOREIGN PATENT DOCUMENTS

| | | | |
|---|---|---|---|
| CA | 2643557 | C | 5/2009 |
| CH | 659679 | A5 | 4/1986 |
| CN | 202755618 | U | 2/2013 |
| CN | 202755811 | U | 2/2013 |
| CN | 203034715 | U | 7/2013 |
| CN | 103470142 | A | 12/2013 |
| CN | 203613950 | U | 5/2014 |
| CN | 203613980 | U | 5/2014 |
| DE | 19748418 | A1 | 5/1999 |
| DE | 10029744 | A1 | 4/2001 |
| DE | 102012110546 | A1 | 5/2014 |
| EP | 53104 | A | 6/1982 |
| EP | 517057 | A2 | 12/1992 |
| EP | 987396 | A2 | 3/2000 |
| EP | 1091075 | A1 | 4/2001 |
| EP | 1338746 | A2 | 8/2003 |
| FR | 2440459 | A1 | 5/1980 |
| FR | 2910509 | A1 | 6/2008 |
| GB | 1054925 | A | 1/1967 |
| GB | 2251645 | A | 7/1992 |
| GB | 2233682 | B | 11/1993 |
| GB | 2468161 | A | 9/2010 |
| KR | 100740254 | B1 | 7/2007 |
| WO | 1001544 | C2 | 2/2010 |

* cited by examiner

QUICK RELEASE CLADDING SYSTEM FOR FENESTRATION FRAMES

CROSS REFERENCE

This application is a continuation of U.S. patent application Ser. No. 14/487,067 filed on Sep. 15, 2014. The entire contents of U.S. patent application Ser. No. 14/487,067 are hereby incorporated by reference.

BACKGROUND

The present disclosure relates to cladded fenestration frames, for example, framed doors, curtain walls, window, skylights, and the like. Specifically, cladded fenestration frames for interior spaces and protected environments.

Framed doors, curtain walls, windows, skylights, and the like are often cladded with a decorative material, such as wood or plastic, over their frames. For cladding exposed to the exterior environment, such as rain, snow, or wind, the claddings is mounted over the frame with an air gap for pressure equalization and so that moisture infiltrating the system can drain through weep holes at the bottom of the frame. For cladding over the frames of framed doors, curtain walls, windows, skylights, and the like, in an interior space or a protected environment, this air gap is not required and the cladding can be flush mounted against the frame.

Cladding over such frames in protected environments is typically applied at the factory and can require a multi-step time consuming or labor intensive process to remove or to reinstall at the installation site.

SUMMARY

Described is quick-release cladding system for interior or protected environments for fenestrations such as doors, windows, skylights, or curtain walls. The cladding can be easily installed and removed on an installed door, window, skylight, or curtain wall. The cladding and fenestration frame are secured with their surfaces tightly engaged. This is in contrast to exterior cladding systems that generally require a gap between exterior cladding and the corresponding frame for pressure equalization and weeping of moisture. To install, the installer would simply push down on the cladding over the fenestration frame to push it into place. To remove, the installed would simply push up on the cladding. An optional keeper bar can be slid into place near the top of the cladding to prevent removal of the cladding once installed.

In one aspect, the quick-release cladding system for an interior environment can include a fenestration frame and a removable cladding that include complementary engaging bracketed surfaces. The bracketed surfaces are so shaped that when engaged, a downward force on the removable cladding causes the removable cladding to move flush against the fenestration frame. Utilizing a two-step engaging process, the downward force causes a downward engaging of surfaces parallel to the length of the cladding and fenestration frame, and causes complementary angled surfaces to pull the cladding and fenestration frame closer together. In one example, the complementary angled surfaces can be at 45-degree angle with respect to the vertical and the surfaces parallel to the length of the cladding and fenestration frame can be vertical surfaces.

The quick-release cladding system can also include a keeper bar inserted between the fenestration frame and the removable cladding above the complementary engaging bracketed surfaces. The keeper bar, the fenestration frame, and the removable cladding are configured to prevent upward movement of the removable cladding. The cladding can be removed by removing the keeper bar, pushing up on the cladding to release the bracketed surfaces from one another and then pulling the cladding forward away from the fenestration frame. The inventor recognized that two-step engaging mechanism described in the preceding paragraph allows the fenestration frame and cladding to be more precisely assembled. This additional precision makes possible the use of the keeper bar.

In one aspect, the bracketed surfaces can include a first retaining clip and a second retaining clip. A first retaining clip is secured to a rear face of the removable cladding and a second retaining clip secured to a front face of the fenestration frame. The first retaining clip and the second retaining clip include complementary surfaces so shaped that when engaged, a downward force on the removable cladding causes the removable cladding to move flush against the fenestration frame. The keeper bar can be inserted above the retaining clips and below one or more slot guides to secure the cladding and to prevent the retaining clips from being disengaged.

One of the advantages of the quick-release cladding system described is the possibility of creating a cladding frame that can be removed from the fenestration frame as a single unit, as opposed to just individual pieces. The cladding frame can be made up of one or more horizontal cladding members and two or more vertical cladding members. In this aspect, the keeper bar can inserted between the fenestration frame and the horizontal cladding member above the complementary engaging bracketed surfaces. Once inserted, the keeper bar locks the cladding frame in place and prevents upward movement.

In another aspect, the quick-release cladding can be installed on a curtain wall frame. The cladding can be L-shaped or u-shaped in order to conceal the horizontal and vertical curtain wall frame members. Retaining clips can be placed on the each inside face of the u-shaped cladding and on corresponding locations on the fenestration frames forming pairs of complementary bracketed surfaces. The bracketed surfaces on the front face of the frame and opposing inside face of the removable cladding are so shaped that when engaged, a downward force on the removable cladding causes the removable cladding to move flush against the fenestration frame. The bracketed surfaces on the side faces of the frame and opposing inside side faces of the removable cladding are so shaped that when engaged, a forward force toward the curtain wall causes the removable cladding to move flush against the fenestration frame.

This Summary introduces a selection of concepts in simplified form that are described the Description. These concepts are not meant to identify essential features or limit the scope of the claimed subject matter. The intent of this summary is to aid in the understanding of this disclosure.

DRAWINGS

DESCRIPTION

For the purpose of this disclosure, the terms "left" or "right" are used as relative terms in relation to the figures. These terms are not used to denote absolute direction, or orientation, and do not imply a preference or limitation for a particular orientation. As defined in this disclosure, fenestration frame refers to a frame associated with a building opening or passage, such as a doorframe, window frame, curtain wall frame, or skylight frame. The fenestration frame can refer to the frame surrounding or defining the opening, for example, a door or window jamb. The fenestration frame can also include the frame surrounding the opening element, such as the frame of a window sash or the frame surrounding a glass door. The fenestration frame can also refer to a framed structure that fills the opening, for example, a curtain wall frame, or a skylight frame.

Figure 1:
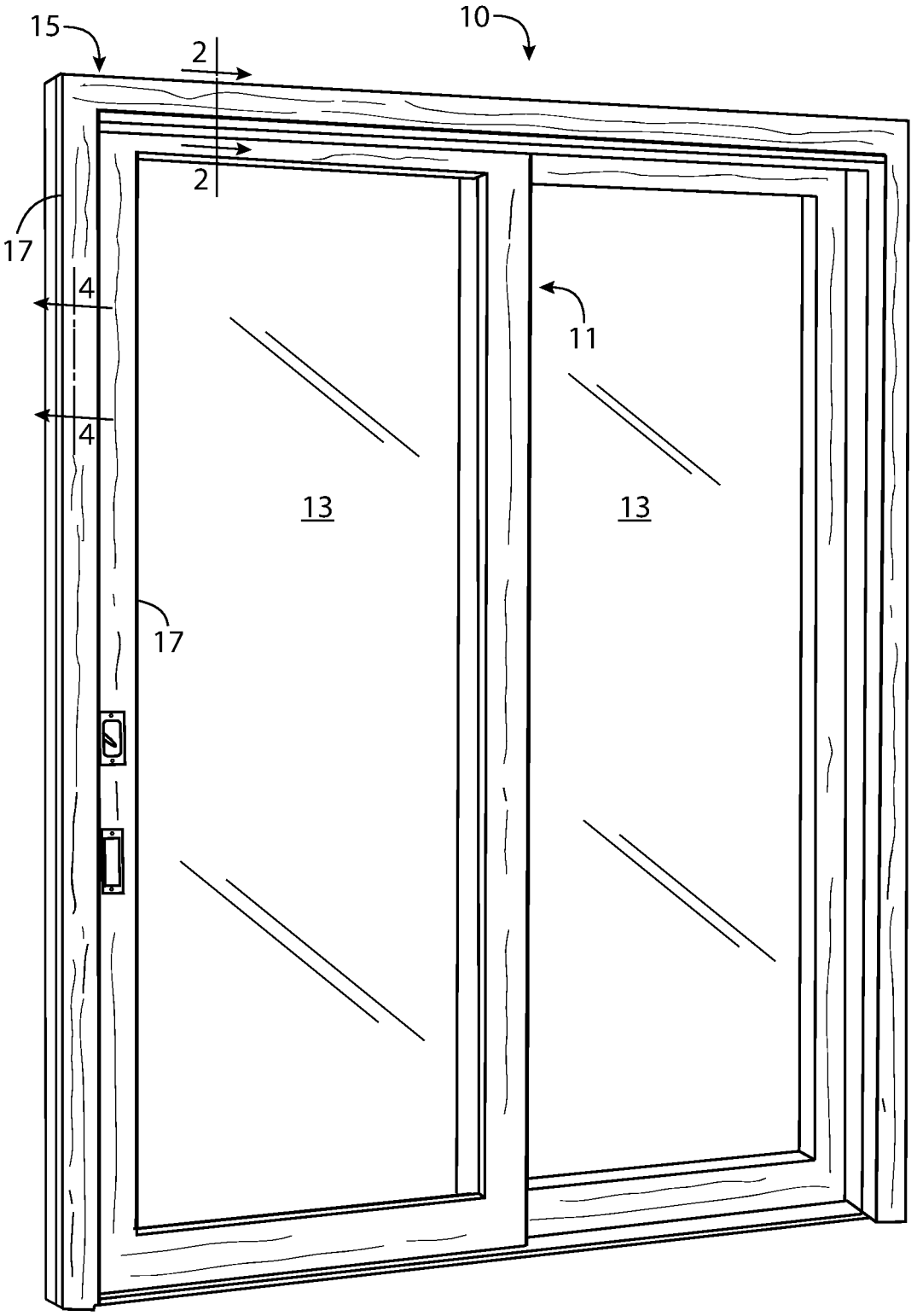
FIG. 1 illustrates a sliding glass door and the jamb surrounding the sliding glass door that includes a cladding system in accordance with this disclosure.

The following description is made with reference to figures, where like numerals refer to like elements throughout the several views, FIG. 1 illustrates a door assembly 10 that includes a sliding glass door 11, with glazing 13, and a jamb 15 surrounding the sliding glass door 11. The side of the door assembly 10 shown is within an interior environment that is protected from outside elements such as rain or wind. Both the sliding glass door 11 and the jamb 15 include removable cladding 17 in accordance with this disclosure. The removable cladding 17 is illustrated as wood. However, the removable cladding 17 can be made of, for example, vinyl, engineered wood, or other materials suitable as cladding material for an interior environment.

Figure 2:
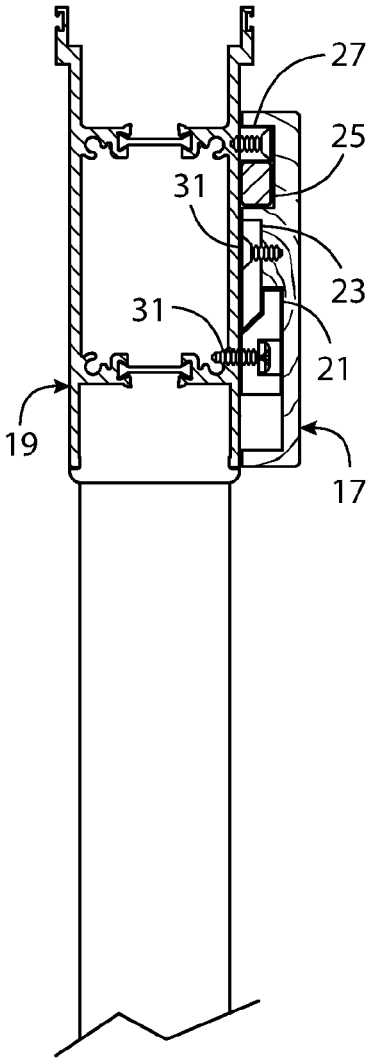
FIG. 2 illustrates the sectional view of FIG. 1 taken along section lines 2-2, illustrating a portion of the header frame.

Referring to FIG. 2, which is a sectional view of FIG. 1 taken along section lines 2-2, the removable cladding 17 is held tightly to the fenestration frame header 19 by a frame-mounted retaining clip 21 and a cladding-mounted retaining clip 23. The removable cladding 17 is held securely to the fenestration frame header 19 by a keeper bar 25. A slot guide 27, secured to fenestration frame header 19, restricts upward movement of the keeper bar 25.

Figure 3:
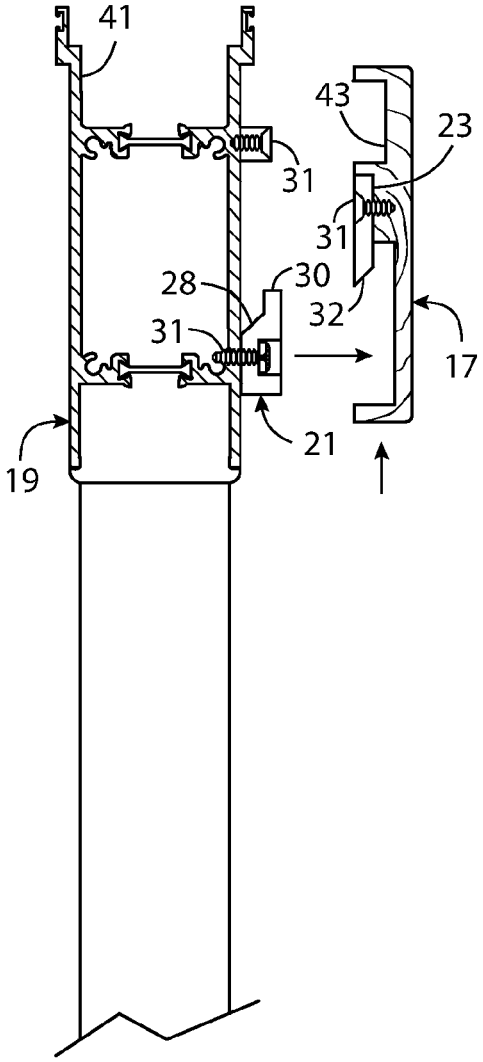
FIG. 3 illustrates a partially exploded view of FIG. 2 showing the cladding removed from the header frame assembly.

In FIG. 3, with the keeper bar 25 of FIG. 2 removed, the removable cladding 17 can be unlocked and removed from the fenestration frame header 19 by a simple upward movement force, typically applied by hand, until the cladding-mounted retaining clip 23 clears the frame-mounted retaining clip 21, followed by a forward motion away from the fenestration frame header 19.

Referring to FIG. 3, the frame-mounted retaining clip 21 and the cladding-mounted retaining clip 23 include complementary bracketed surfaces. The frame-mounted retaining clip 21 includes an angled surface 28 below the end portion 30. The cladding-mounted retaining clip 23 includes an angled end 32. The angled surface 28 and angled end 32 make the same angle with respect to the vertical. Referring to FIG. 2, the complementary bracketed surfaces, formed by the arrangement of the frame-mounted retaining clip 21, the cladding-mounted retaining clip 23, the angled end 32 and the angled surface 28 and causes a downward force on the removable cladding 17 to draw the removable cladding 17 closer to the fenestration frame header 19. This is accomplished in two steps: first, the vertical surfaces of the frame-mounted retaining clip 21 and the cladding-mounted retaining clip 23 engage in a downward motion, and second, the angled end 32 and angled surface engage to draw the removable cladding 17 and fenestration frame header 19 tightly together. This two-step securing mechanism forces the fenestration frame header 19 and removable cladding 17 together with greater precision then a simple straight bracket and allows for the possibility of tightly engaging the keeper bar 25. The keeper bar 25, once in place, will resist upward movement and lock the fenestration frame header 19 and the removable cladding 17 together. In FIG. 3, with the keeper bar removed 25, an upward force on the removable cladding draws the removable cladding 17 away from the fenestration frame header 19.

Figure 4:
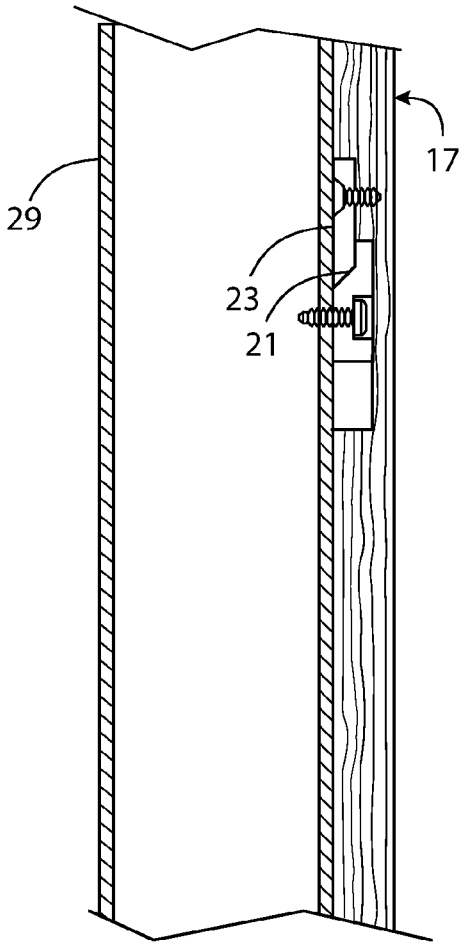
FIG. 4 illustrates a sectional view of FIG. 1 taken along section lines 4-4 illustrating a portion of the vertical frame assembly.
Figure 5:
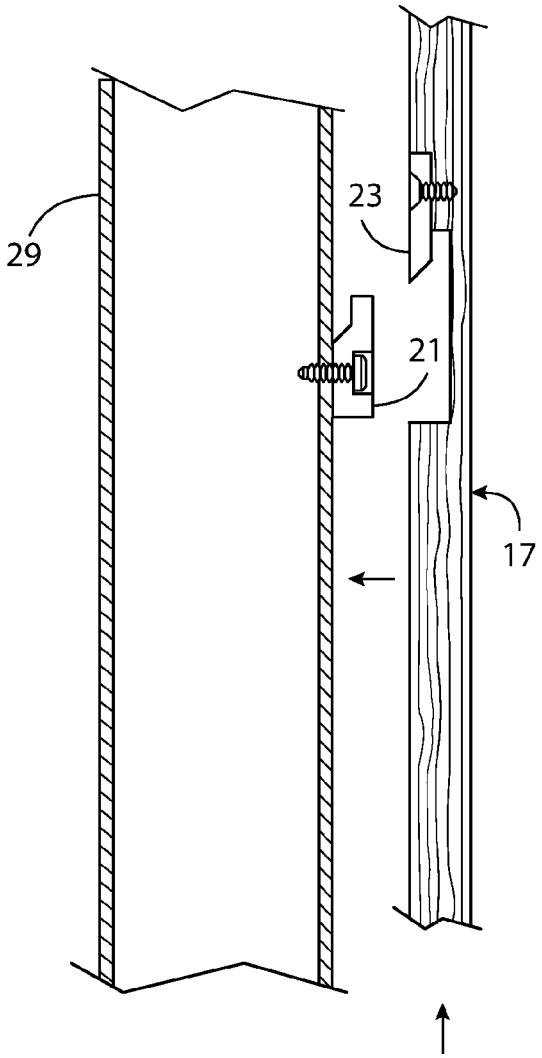
FIG. 5 illustrates a partially exploded view of FIG. 4 showing the cladding assembly removed from the vertical frame assembly.

FIG. 4 similarly shows a sectional view of FIG. 1 taken along section lines 4-4 illustrating the attachment of the removable cladding 17 to the vertical fenestration frame element 29 utilizing the cladding-mounted retaining clip 23 and frame-mounted retaining clip 21 in a similar arrangement as in FIG. 2. The vertical portion of the removable cladding 17 of FIG. 4 can be rigidly secured to the horizontal header portion of the removable cladding 17 of FIG. 2 forming a three-sided frame. In this arrangement, referring to FIGS. 3 and 5, after the keeper bar 25 of FIG. 2 is removed, the removable cladding 17 can be unlocked and removed from the fenestration frame header 19 of FIG. 2 and the vertical fenestration frame element 29 of FIG. 5 by a simple upward movement force, typically applied by hand, until the cladding-mounted retaining clips 23 clears the frame-mounted retaining clips 21, followed by a forward motion away from the fenestration frame header 19 and the vertical fenestration frame element 29.

In FIGS. 2 and 3, threaded fasteners 31 secure the frame-mounted retaining clip 21, the cladding-mounted retaining clip 23 and the slot guides 27. The type of threaded fastener 31 used would depend on materials being fastened, for example, a wood screw to secure the cladding-mounted retaining clip 23 to the removable cladding 17 made of wood or wood composite, or a sheet metal screw to secure the frame-mounted retaining clip 21 or the slot guide 27 to the fenestration frame made of aluminum or steel. These are examples are meant to be illustrative of the type of threaded fasteners 31 that could be used, and possible materials for various components, are no way meant to be limiting. The reader skilled in the art will readily recognize other appropriate forms of threaded fasteners 31.

Figure 6:
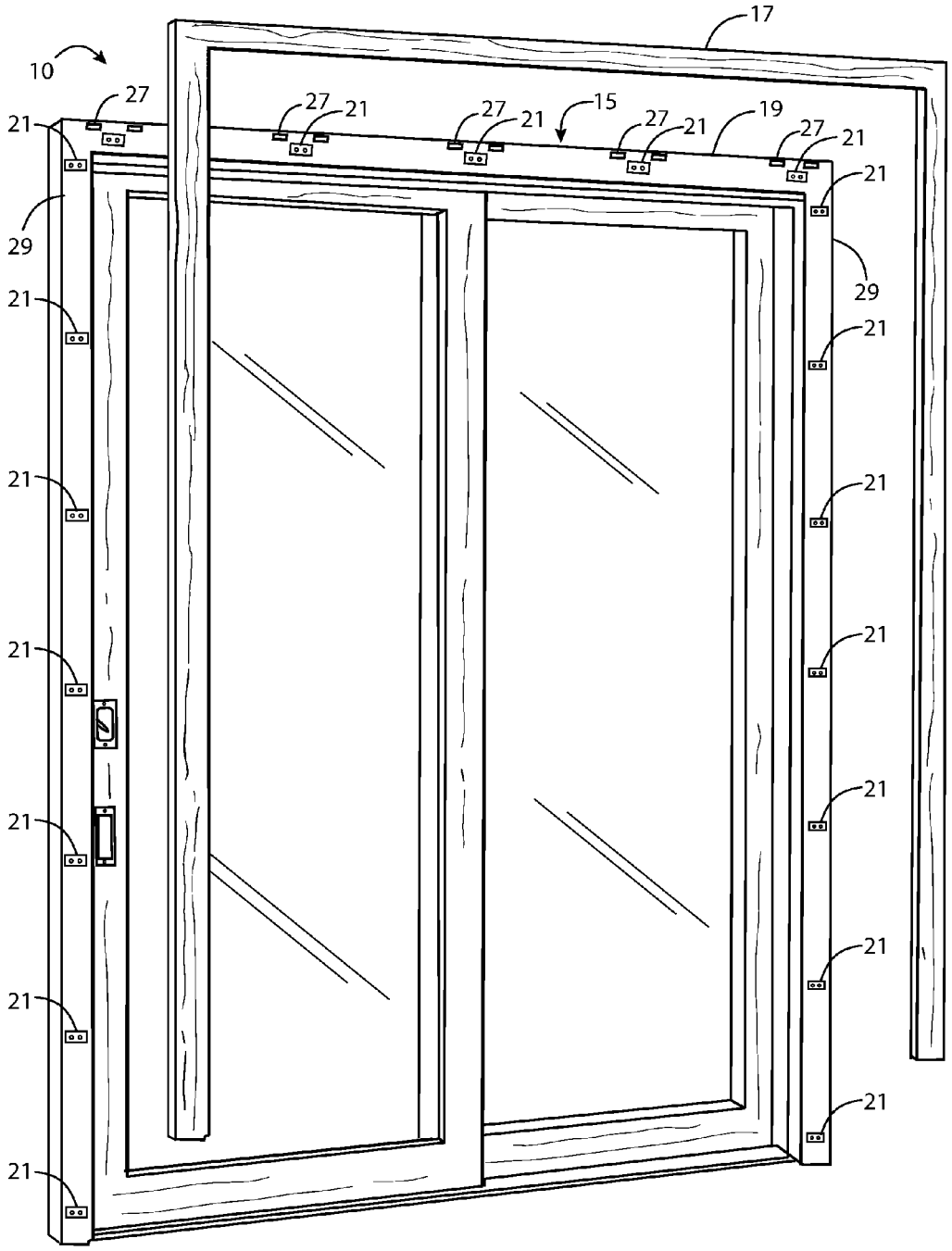
FIG. 6 illustrates the cladding removed from the fenestration frame revealing a portion of the attachment system.

FIG. 6 illustrates the door assembly 10 resulting from the removal of the removable cladding 17 from the jamb 15 showing the fenestration frame header 19, the vertical fenestration frame elements 29, the frame-mounted retaining clips 21, and the slot guides 27. The removable cladding 17 is shown removed as a complete unit.

Figure 7:
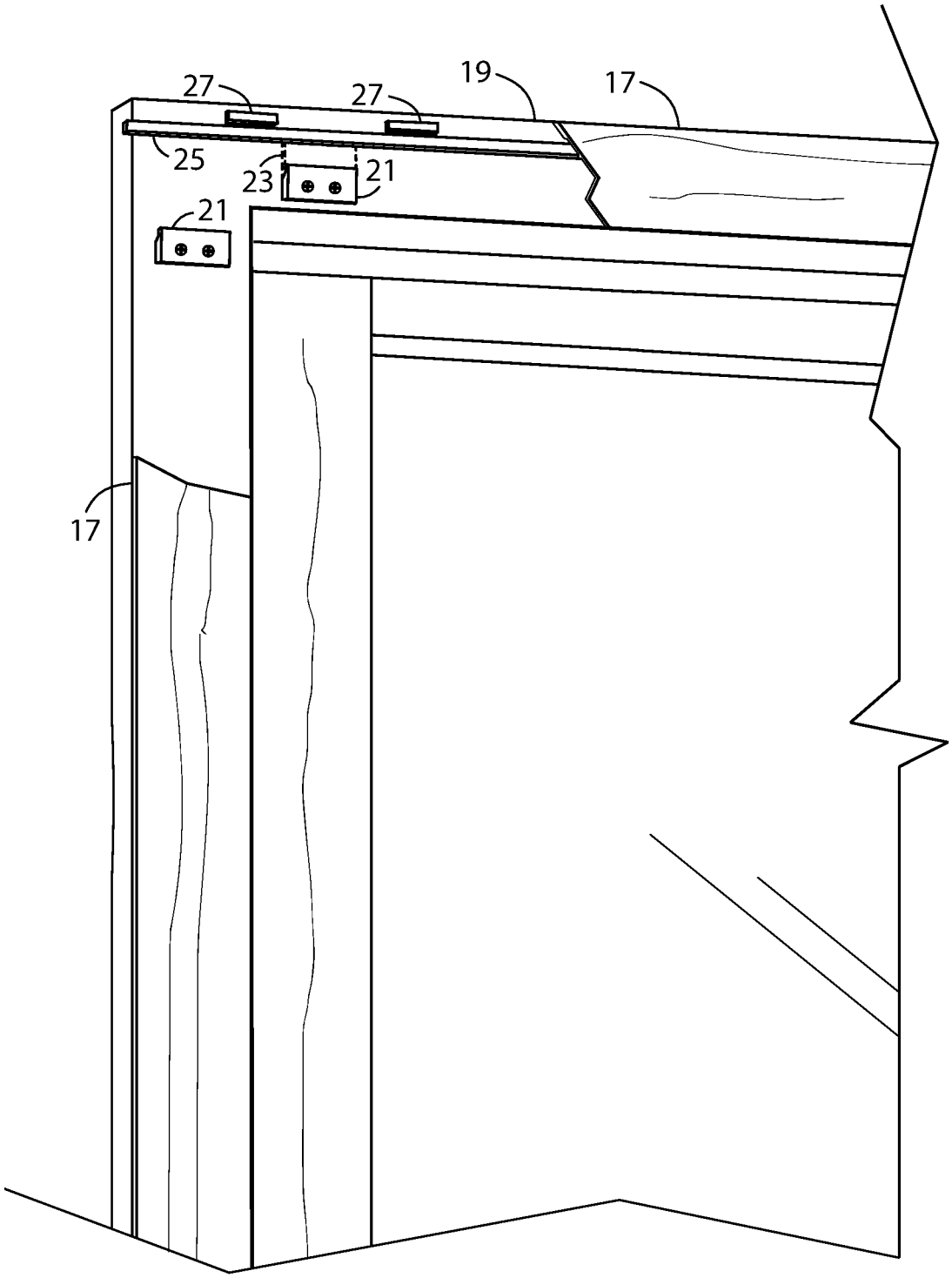
FIG. 7 illustrates a detail view of the upper left hand portion of FIG. 1 in partial cutaway.
Figure 8:
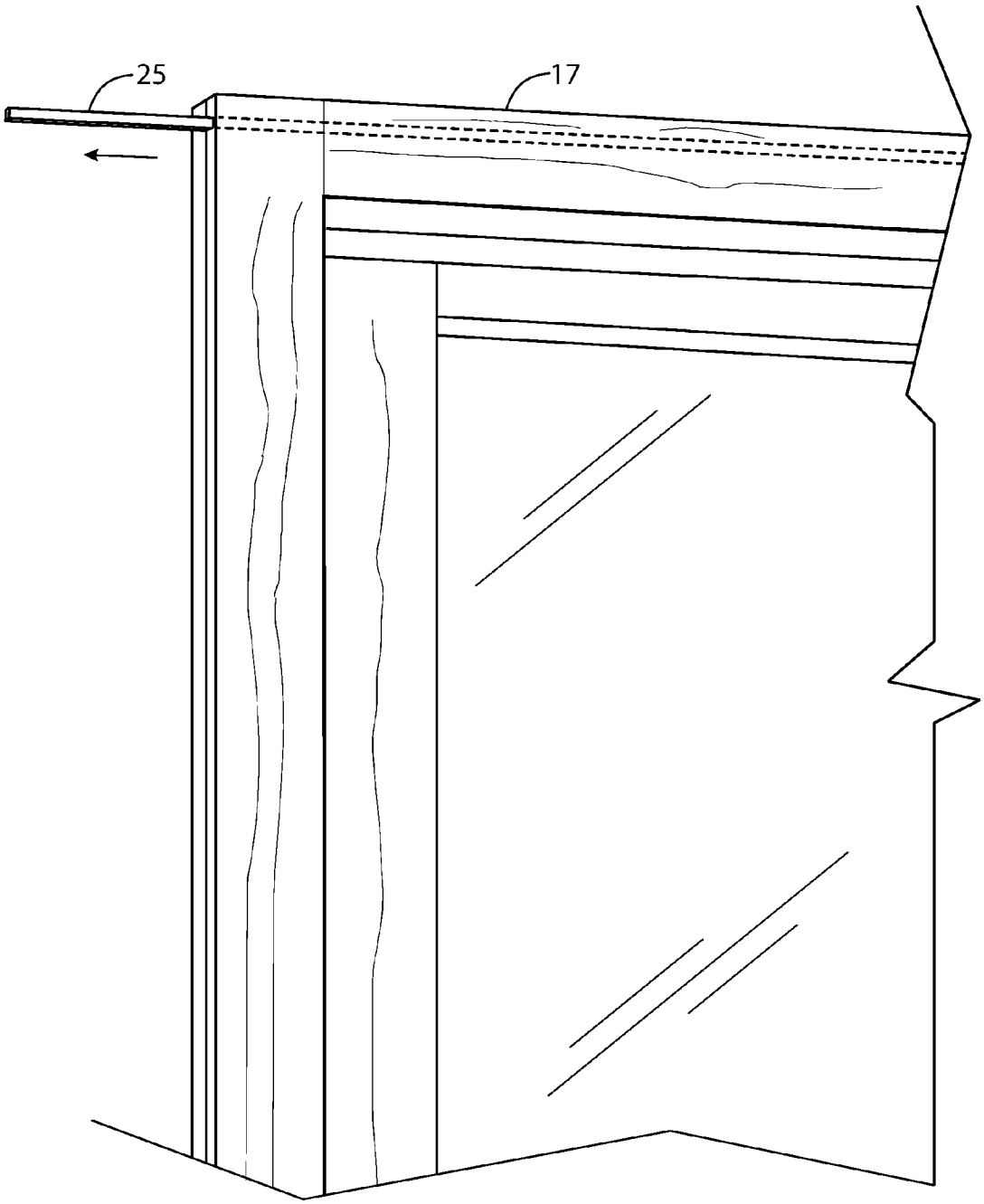
FIG. 8 illustrates a detail view of the upper left hand portion of FIG. 1 showing partial removal of the keeper bar.

Thus far, the keeper bar 25, has been illustrated only in sectional view in FIG. 2. For clarity, FIGS. 7 and 8 illustrates the relationship of the keeper bar 25 to the fenestration frame header 19 and the removable cladding 17, in front view. FIG. 7 illustrates a detail view of the upper left hand portion of FIG. 1 in partial cutaway. The keeper bar 25 is shown resting between the slot guides 27 and the top of the cladding-mounted retaining clip 23 above the frame-mounted retaining clips 21 in the cutaway portion. The cladding-mounted retaining clip 23 is shown in broken lines because it is not present in the view but shown to illustrate its relationship with the keeper bar 25. FIG. 8 illustrates a detail view of the upper left hand portion of FIG. 1 showing partial removal of the keeper bar 25. For clarity, the keeper bar 25 is represented by dashed lines, as it is hidden from view under the removable cladding 17.

Figure 9:
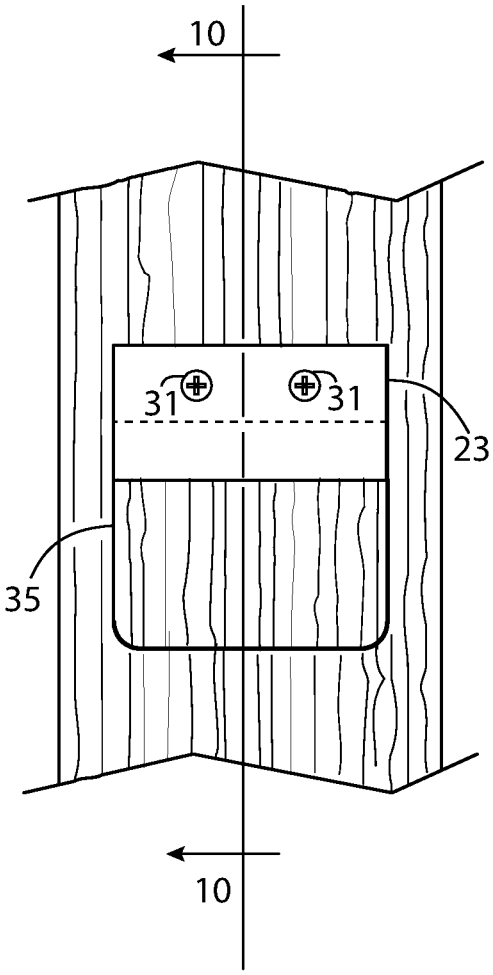
FIG. 9 illustrates a portion of the frame-facing side of the cladding illustrating the cladding-attached mounting clip and wood cutout.
Figure 10:
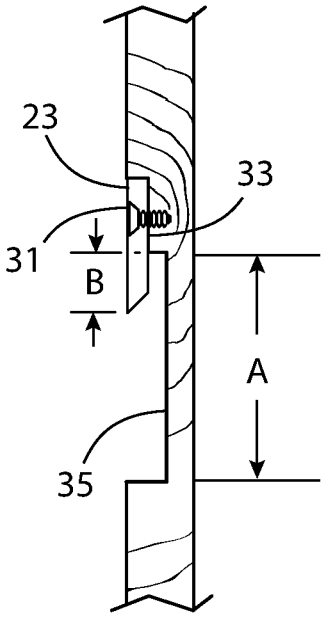
FIG. 10 illustrates a sectional view of FIG. 9 taken along section lines 10-10.
Figure 11:
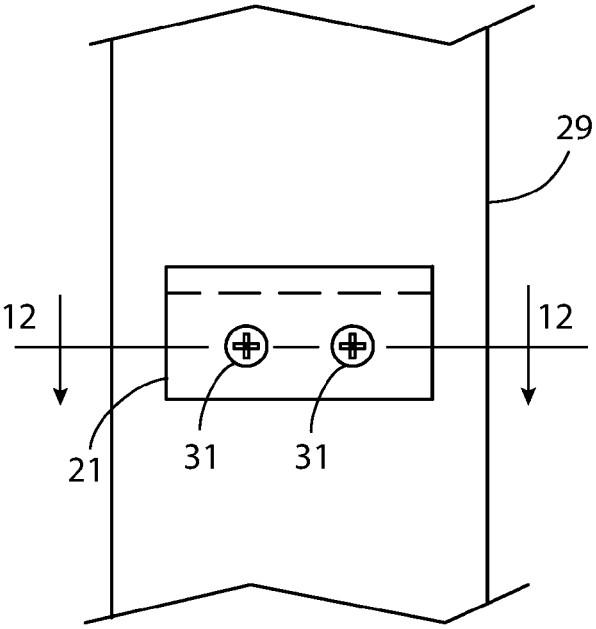
FIG. 11 illustrates the complementary portion to FIG. 9 of the cladding-facing side of the jamb, showing the frame-attached mounting clip.
Figure 13:
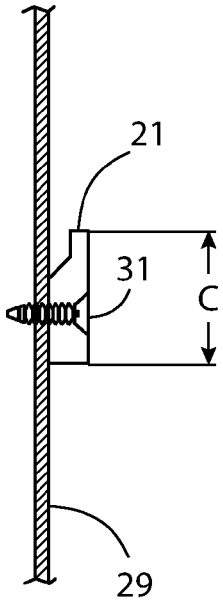
FIG. 13 illustrates a sectional view of FIG. 12 taken along section lines 13-13.
Figure 12:
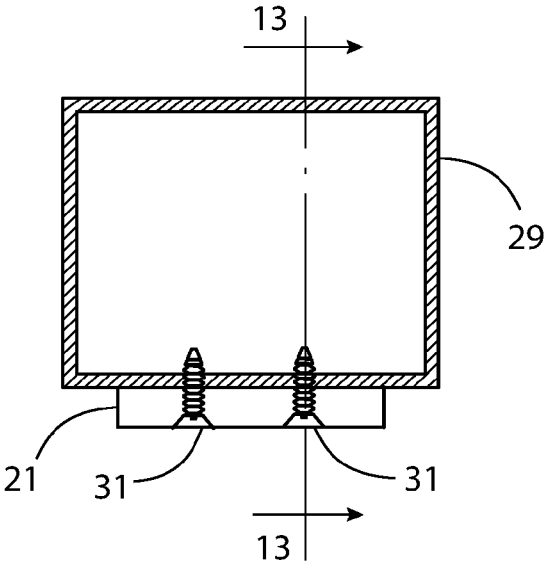
FIG. 12 illustrates a sectional view of FIG. 11 taken along section lines 12-12.

FIGS. 9 and 10 illustrate, in one aspect, a detail view of the cladding-mounted retaining clip 23 in relation to removable cladding 17. FIGS. 11-13 illustrate a detail view of the frame-mounted retaining clip 21 in relationship to a corresponding portion of the vertical fenestration frame element 29. FIG. 9 illustrates a portion of the frame-facing side of the cladding illustrating the cladding-attached mounting clip and wood cutout. FIG. 10 illustrates a sectional view of FIG. 9 taken along section lines 10-10. FIG. 11 illustrates the complementary portion to FIG. 9 of the cladding-facing side of the jamb. FIG. 12 illustrates a sectional view of FIG. 12 taken along section lines 12-12. FIG. 13 illustrates a sectional view of FIG. 12 taken along section lines 13-13. In FIGS. 11-13, the frame-mounted retaining clip 21 is shown attached the vertical fenestration frame element 29 by the threaded fasteners 31.

Referring to FIGS. 9 and 10, the cladding-mounted retaining clip 23 is shown fastened to the inside surface of the removable cladding by threaded fasteners 31. In FIG. 10, the cladding-mounted retaining clip 23 is mounted to a first recess 33 of the removable cladding 17. The first recess 33 is shown approximately the same depth of the removable cladding 17 so that cladding-mounted retaining clip 23 mounts flush against the inside surface of the removable cladding 17. Referring to FIGS. 9 and 10, a lower portion of the cladding-mounted retaining clip 23 is mounted over a second recess 35. In FIG. 9, the top of the second recess is hidden, and is represented by a dashed line across the cladding-mounted retaining clip 23. The width of the second recess 35 is approximately the same width as the cladding-mounted retaining clip 23. In FIG. 11, the width of the frame-mounted retaining clip 21 is approximately the same width as the cladding-mounted retaining clip 23.

Referring to FIGS. 9,10, and 13, the height of the second recess 35 is at least as long as the sum of the height of the frame-mounted retaining clip 21 plus the overhang length of the cladding-mounted retaining clip 23. In FIG. 10, the height of the second recess 35 is indicated by the letter A, and the overhang length of the cladding-mounted retaining clip is indicated by the letter B. In FIG. 13, the height of the frame-mounted retaining clip 21 is indicated by the letter C.

Figure 14:
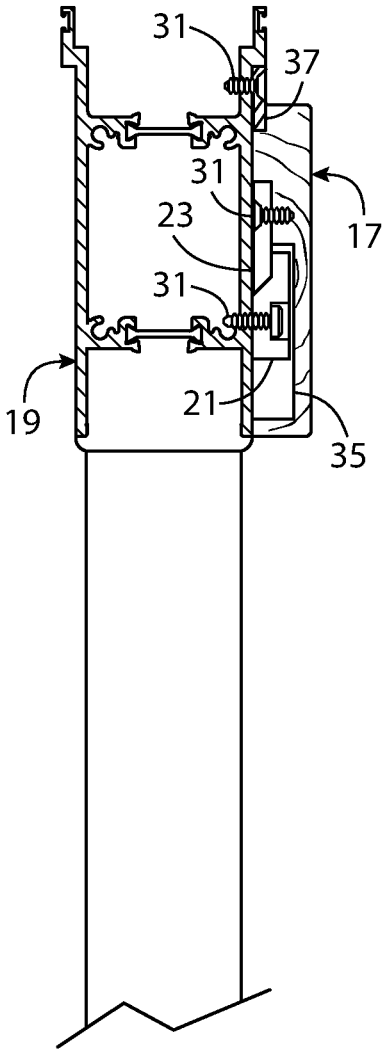
FIG. 14 illustrates a first alternative structure to FIG. 2, with a screw-down keeper bar.
Figure 15:
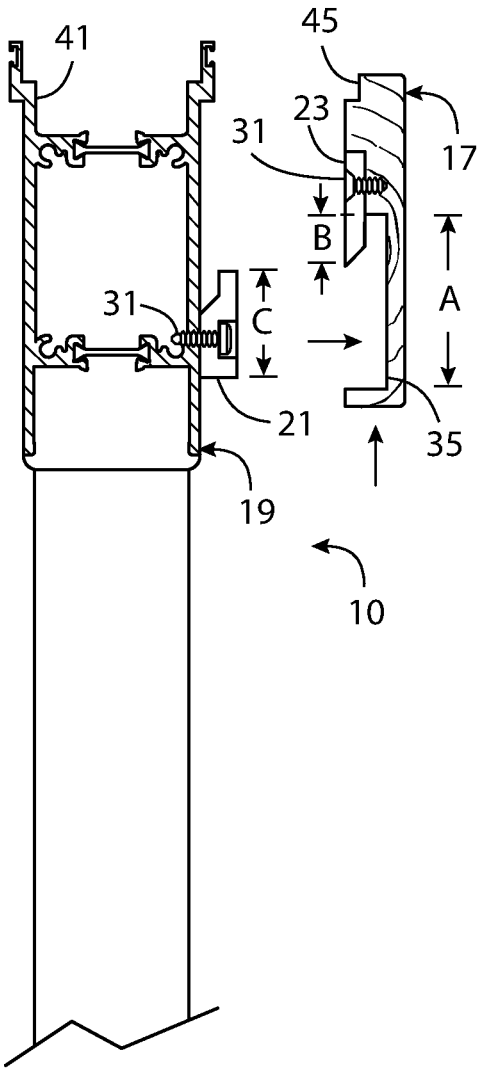
FIG. 15 illustrates a partially exploded view of FIG. 14 showing the cladding removed from the frame assembly.
Figure 16:
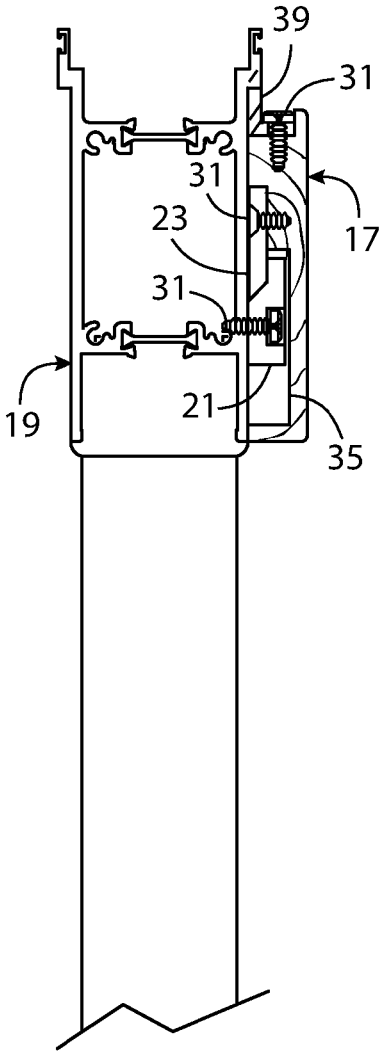
FIG. 16 illustrates a second alternative structure to FIG. 2, with an I-bracket keeper bar.
Figure 17:
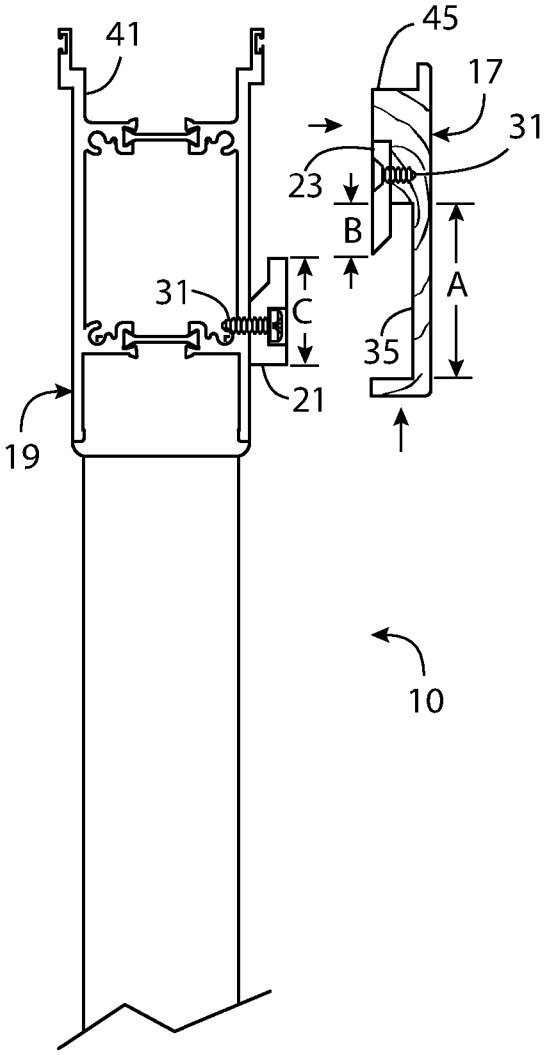
FIG. 17 illustrates a partially exploded view of FIG. 16 showing the cladding removed from the frame assembly.

In FIG. 2 the removable cladding 17 is shown held securely to the fenestration frame header 19 by the keeper bar 25. FIG. 3 shows the result of removing the keeper bar 25 and removal of the removable cladding 17 from the fenestration frame header 19 by an upward and outward movement of the removable cladding 17. FIGS. 14 and 16 illustrate alternative fenestration frame and keeper bar structures. FIG. 14 illustrates a first alternative structure to FIG. 2, with a screw-down keeper bar 37. FIG. 15 illustrates a partially exploded view of FIG. 14 showing the removable cladding 17 removed from the fenestration frame header 19. FIG. 16 illustrates a second alternative structure to FIG. 2, with an L-bracket keeper bar 39. FIG. 17 illustrates a partially exploded view of FIG. 16 showing the removable cladding 17 removed from the fenestration frame header 19.

In FIGS. 14-17, the frame-mounted retaining clip 21, the cladding-mounted retaining clips 23, and the threaded fasteners 31 are configured with respect to the fenestration frame header 19 and the removable cladding 17 in a similar manner as described for FIGS. 2 and 3. The height of the second recess 35 is at least as long as the sum of the height of the frame-mounted retaining clip 21 plus the overhang length of the cladding-mounted retaining clip 23. In FIGS. 15 and 17, the height of the second recess 35 is indicated by the letter A, the overhang length of the cladding-mounted retaining clip is indicated by the letter B, and the height of the frame-mounted retaining clip 21 is indicated by the letter C.

Referring to FIGS. 3, 15, and 17, the frame header upper portion 41 is longer on FIG. 3 as compared with FIG. 15 or 17 to accommodate a longer version of the removable cladding 17. The door assembly 10 of FIGS. 15 and 17 do not require the slot guide 27 of FIG. 3 because both the screw-down keeper bar 37 of FIG. 15 and the L-bracket keeper bar 39 of FIG. 17 screw into the fenestration frame header 19. The removable cladding of FIG. 3 is longer than the removable cladding illustrated in FIGS. 15 and 17 in order to provide for a third recess 43. The third recess 43 is sized to hold snuggly both the slot guide 27 and the keeper bar 25. The cladding top inside portion 45 in FIG. 15 is shaped to accommodate the screw-down keeper bar 37. In FIG. 15, the cladding top inside portion 45 covers a part of screw-down keeper bar 37, but leaves the head of the threaded fastener 31 uncovered. In FIG. 17, the cladding top inside portion 45 is shaped so that the base of the L-bracket keeper bar 39 can be secured to the removable cladding 17 by the threaded fastener 31.

Figure 18:
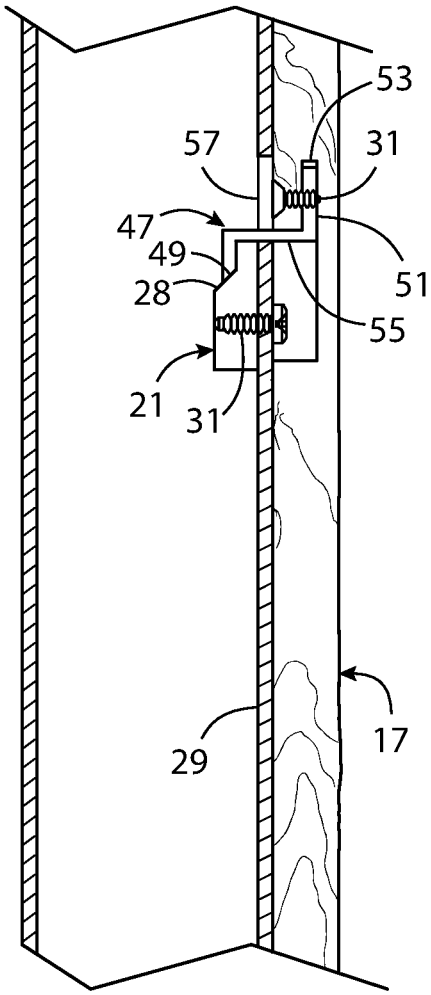
FIG. 18 illustrates a first alternative structure to FIG. 4.
Figure 19:
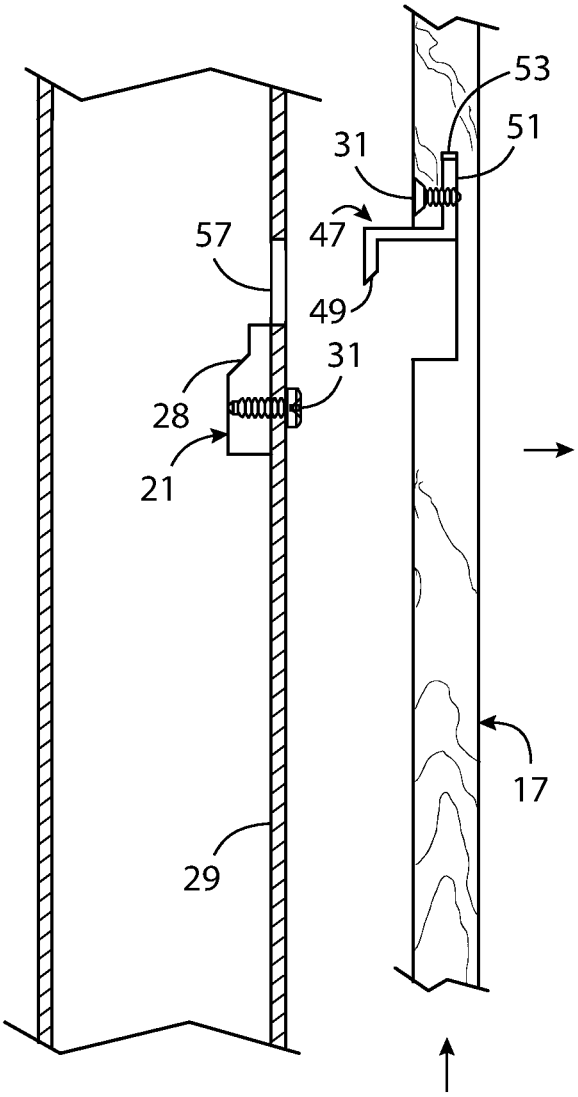
FIG. 19 illustrates a partially exploded view of FIG. 18 showing the cladding removed from the frame assembly.
Figure 20:
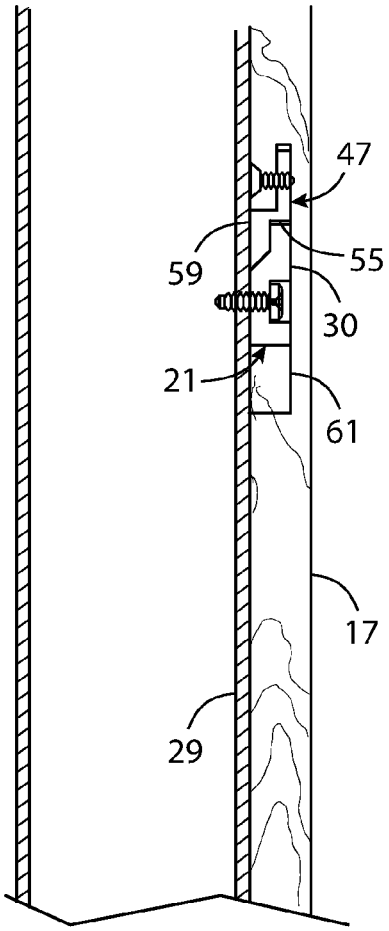
FIG. 20 illustrates a second alternative structure to FIG. 4.
Figure 21:
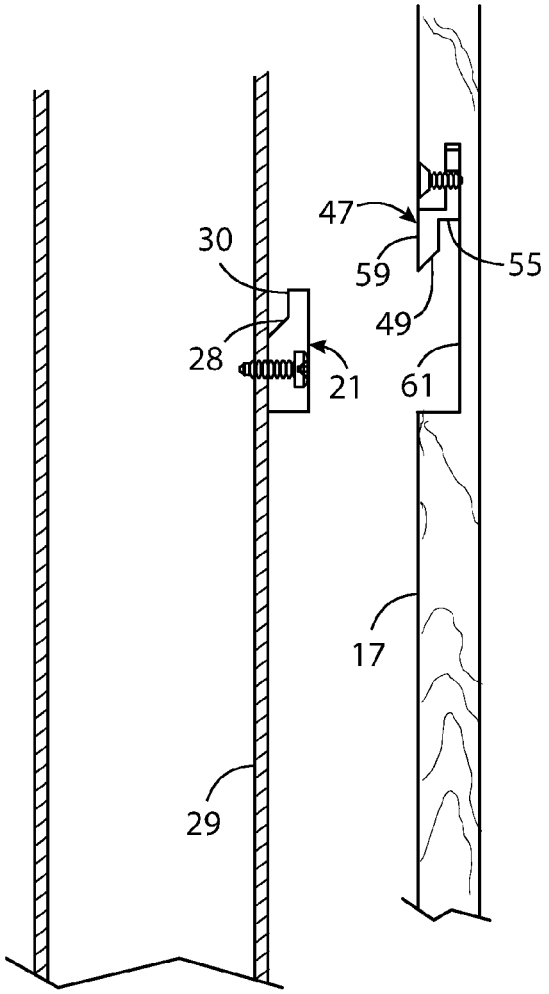
FIG. 21 illustrates a partially exploded view of FIG. 20 showing the cladding removed from the frame assembly.
Figure 22:
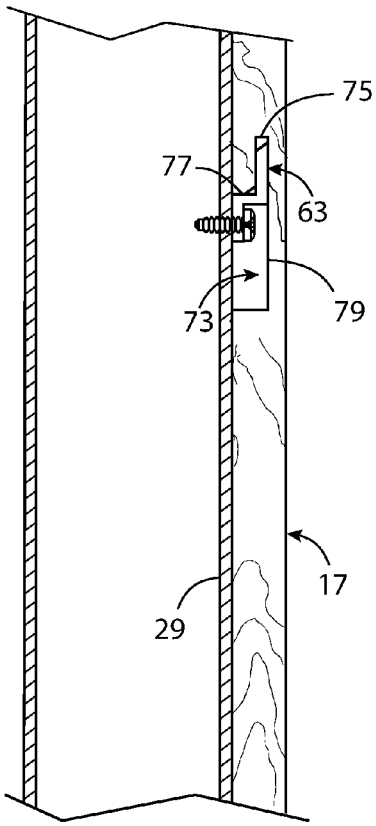
FIG. 22 illustrates a third alternative structure to FIG. 4.
Figure 23:
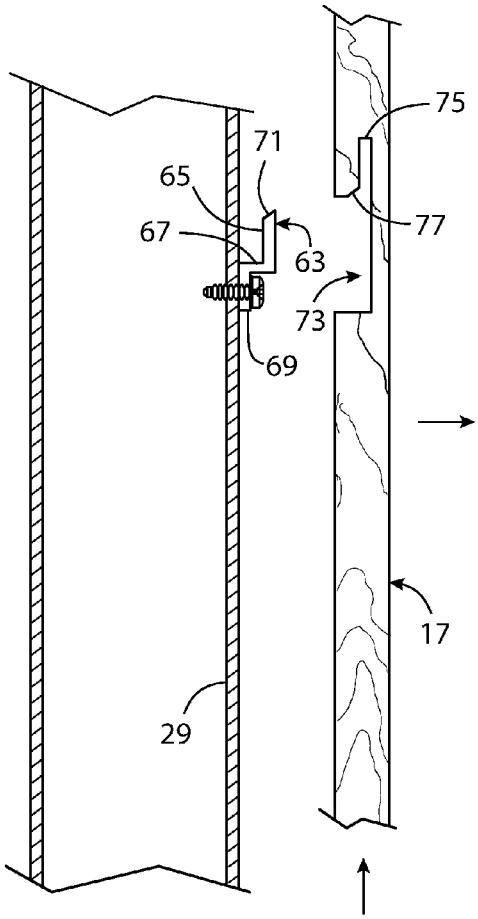
FIG. 23 illustrates a partially exploded view of FIG. 22 showing the cladding removed from the frame assembly.

FIGS. 18-23 illustrates an alternative sectional view of FIG. 4 taken along section lines 4-4 showing several alternative retaining arrangements. Each of these includes examples of alternatively complementary bracketed surfaces. FIG. 18 illustrates a first alternative structure to FIG. 4. FIG. 19 illustrates a partially exploded view of FIG. 18 showing the cladding removed from the frame assembly. FIG. 20 illustrates a second alternative structure to FIG. 4. FIG. 21 illustrates a partially exploded view of FIG. 20 showing the cladding removed from the frame assembly. FIG. 22 illustrates a third alternative structure to FIG. 4. FIG. 23 illustrates a partially exploded view of FIG. 22 showing the cladding removed from the frame assembly.

Referring to FIGS. 18 and 19, the cladding-mounted retaining clip 47 is a z-bracket with an angle cut end 49. The angle cut end 49 makes the same angle with the vertical as the angled surface 28 of the frame-mounted retaining clip 21. In FIG. 18, this arrangement causes a downward force on the removable cladding 17 to pull the removable cladding 17 closer to the vertical fenestration frame element 29. The z-bracket mid-portion 55 width is configured so that the removable cladding 17 is held tightly against the vertical fenestration frame element 29 at a position along the path of engagement between the angle cut end 49 and the angled surface 28 of the frame-mounted retaining clip 21. The angle cut end 49 and the angled surface 28 forms a pair of complementary bracketed surfaces.

In FIGS. 18 and 19, the frame-mounted retaining clip 21 is mounted on the inside of the vertical fenestration frame element 29 and secured by one of the threaded fasteners 31; the vertical fenestration frame element 29 is shown as being hollow. The upper bracket portion 51 of the cladding-mounted retaining clip 47 is secured by another of the threaded fastener 31 into a groove 53 in the removable cladding 17. The cladding-mounted retaining clip 47 engages the frame-mounted retaining clip 21 through an aperture 57 in the vertical fenestration frame element 29.

In FIGS. 20 and 21, the z-bracket mid-portion 55 of the cladding-mounted retaining clip 47 is shortened as compared with FIGS. 18 and 19 so that the front of the lower bracket portion 59 of the cladding-mounted retaining clip 47 is flush with the frame-facing side of the removable cladding 17. The frame-mounted retaining clip 21 is mounted to the vertical fenestration frame element 29 as previously describe for FIGS. 4 and 5. The angle cut end 49 of the cladding-mounted retaining clip 47 makes the same angle relative to its front vertical edge as the angled surface 28 of the frame-mounted retaining clip makes relative its frame-facing edge. The angle cut end 49 and the angled surface 28 form a complementary bracketed surfaces. This arrangement causes a downward force on the removable cladding 17 to pull the removable cladding 17 closer to the vertical fenestration frame element 29 in two steps. First, by engaging the lower bracket portion 59 with the z-bracket mid-portion 55 in a downward motion, and second by drawing the removable cladding 17 and the vertical fenestration frame element 29 closer together along the angle cut end 49 and the angled surface 28. The removable cladding 17 is secured against upward or outward movement by the keeper bar 25 of FIG. 2, or alternatively, by the screw-down keeper bar 37 of FIG. 14, or by the L-bracket keeper bar 39 of FIG. 16. A cladding-recess 61 is similarly structured to the second recess 35 of FIGS. 9 and 10. The depth of the cladding-recess is sized so that the end portion 30 of the frame-mounted retaining clip 21 can be received and held snuggly against the bottom of the z-bracket mid-portion 55 and the inside facing surface of the lower bracket portion 59 of the cladding-mounted retaining clip 47.

In FIGS. 22 and 23, a frame-mounted retaining clip 63 is in the form of a z-bracket. Illustrated in FIG. 23, the frame-mounted retaining clip 63 includes an upper bracket portion 65, a z-bracket mid-portion 67, and a lower bracket portion 69. The upper bracket portion 65 includes an angled end 71. The angled end 71 slopes toward the vertical fenestration frame element 29. The frame-mounted retaining clip 63 is secured to the vertical fenestration frame element 29 by one of the threaded fasteners 31. The frame-mounted retaining clip 63 alternatively be welded, riveted, or otherwise securely fastened the vertical fenestration frame element 29.

In FIGS. 22 and 23, the cladding-mounted retaining previously described is replaced by cladding-recess 73 in side of the removable cladding 17 facing the vertical fenestration frame element 29. The cladding-recess 73 includes a slot 75, an angled surface 77, and a clip receiving area 79. The slot 75 is sized to be approximately the same depth and height as the upper bracket portion 65 of the frame-mounted retaining clip 63. The depth of the clip receiving area 79 is approximately the same as entire depth of the frame-mounted retaining clip 63. The depth of the frame-mounted retaining clip 63 is equal to the width of the z-bracket mid-portion 67 including the thickness of both the lower bracket portion 69 and the upper bracket portion 65. The height of the clip receiving area 79 is at least as tall as the total height of the frame-mounted retaining clip 63. The angle of the angled end 71 and the angled surface 77 is the same forming complementary bracketed surfaces. The above-described arrangement, allows the frame-mounted retaining clip 63 to be securely held within the cladding-recess 73 with the removable cladding 17 and vertical fenestration frame element 29 held flushly together, as shown in FIG. 22. This is accomplished by a two-step process: first, the removable cladding 17 and the vertical fenestration frame element 29 are drawn closer together along the angled end 71 and the angled surface 77, and second, the vertical fenestration frame element 29 and the removable cladding 17 are vertically downwardly engaged along the slot 75 and the upper bracket portion 65. The removable cladding 17 is held in place by one of the keeper bars, previously described. For example, the keeper bar 25 in the fenestration frame header 19 as shown in FIG. 2 or alternatively, the screw-down keeper bar 37 shown in FIG. 14, or the L-bracket keeper bar 39 as shown in FIG. 16.

The arrangement of various components of the frame-mounted retaining clip and the cladding-recess 73 also allows the removable cladding 17 to be removed from the vertical fenestration frame element 29 by a simple upward and outward movement, as illustrated in FIG. 23, once the keeper bar is removed.

Figure 24:
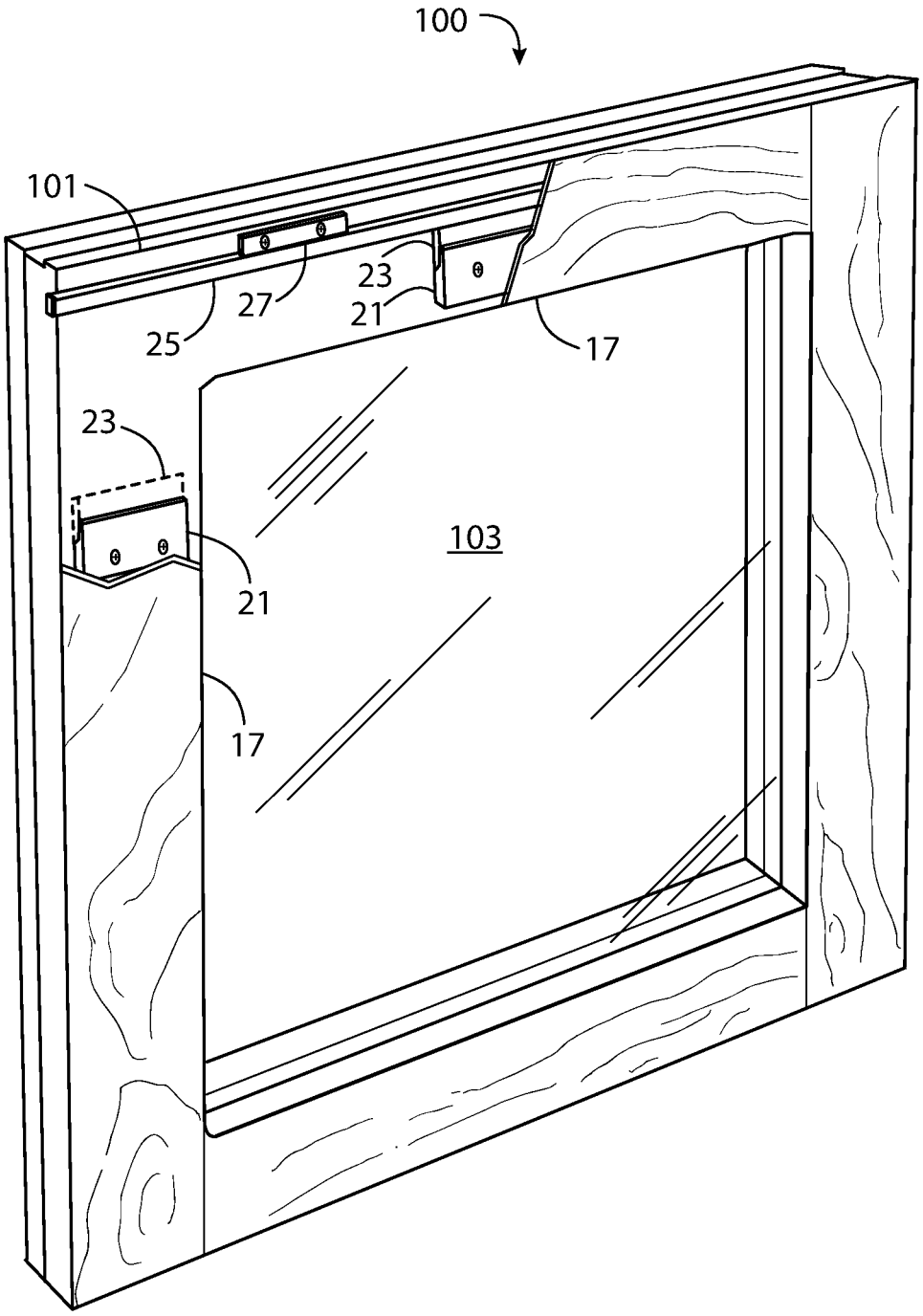
FIG. 24 illustrates a window, in partial cutaway view, that includes a cladding system in accordance with this disclosure

As previously stated, the disclosed removable cladding assembly can be applied to doors, windows, curtain walls, skylights, and other fenestrations. While the FIGS. 1-23 have illustrated the removable cladding assembly applied to a doorframe assembly, the same principles and examples can be directly applied to other fenestrations. FIGS. 24-28 illustrate a window that includes a cladding system in accordance with this disclosure. FIG. 24 illustrates the window 100 in partial cutaway view showing the window frame 101, removable cladding 17, and glazing 103. The cutaway of the removable cladding 17 in the upper left of the window 100 reveals a portion of the window frame 101, the frame-mounted retaining clip 21, a portion of the cladding-mounted retaining clip 23, and the keeper bar 25.

Figure 25:
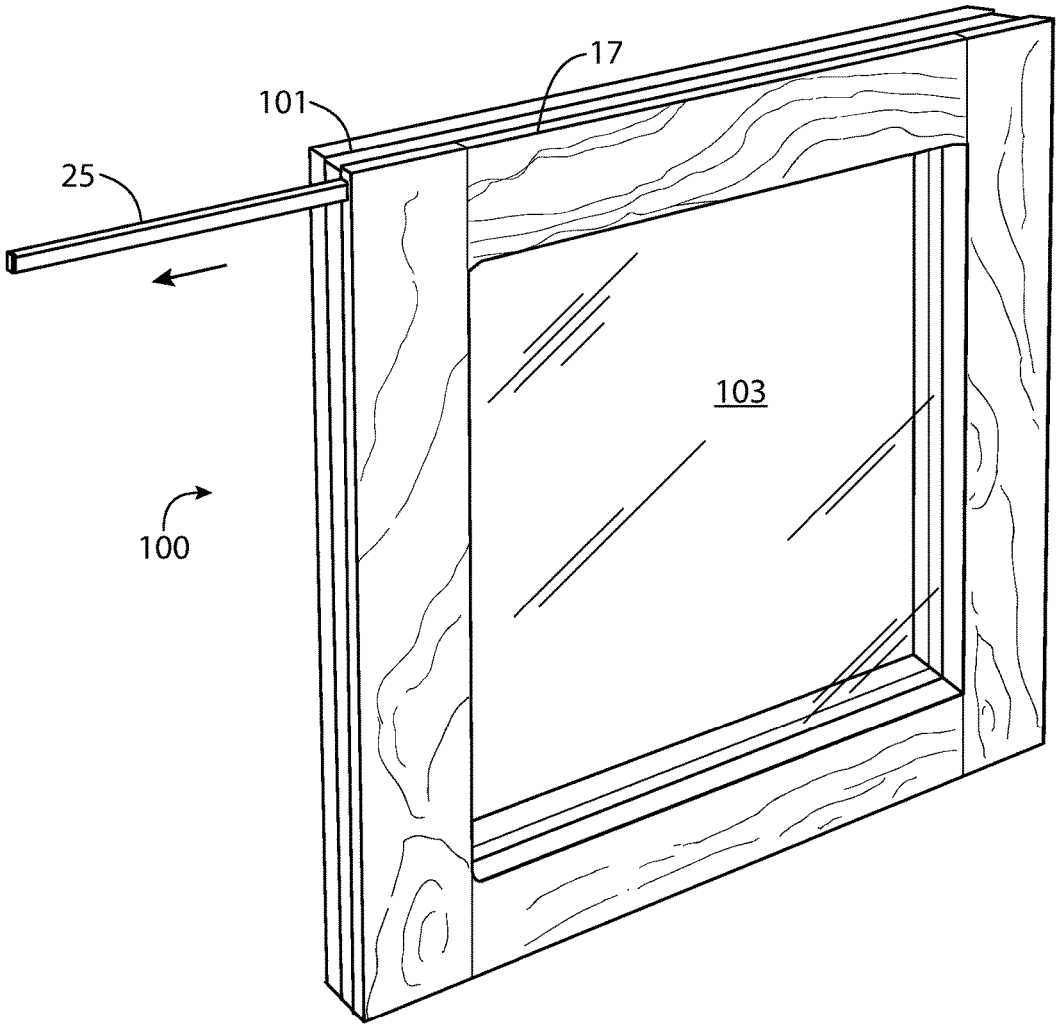
FIG. 25 illustrates the window of FIG. 24 showing the keeper bar being removed.
Figure 26:
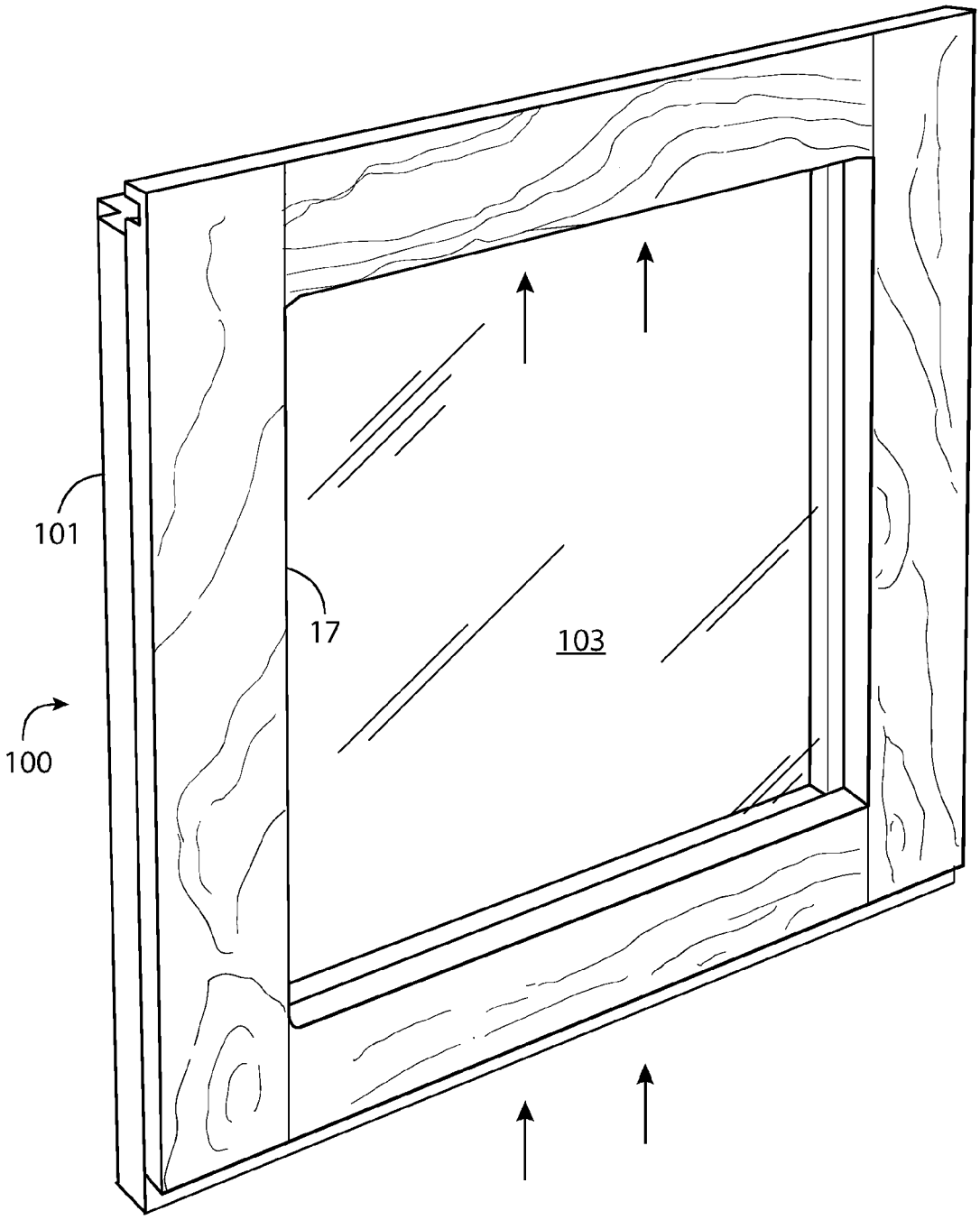
FIG. 26 illustrates the window of FIG. 24 showing how to remove the cladding from the frame after the keeper bar is removed.

FIG. 25 illustrates the window 100, window frame 101, glazing 103, and removable cladding 17 showing the keeper bar 25 being removed from the window frame 101. FIG. 26 illustrates the window 100, window frame 101, glazing 103, and removable cladding 17 showing the removal of the removable cladding 17 from the window frame 101 after the keeper bar 25 is removed. The removable cladding 17 is removed from the window frame 101 and glazing 103 by first removing the keeper bar 25, as shown in FIG. 25, and then pushing up on the removable cladding 17 and pulling forward, as shown in FIG. 26, similar to the manner described for removing the removable cladding 17 from the fenestration frame header 19 and the vertical fenestration frame element 29 in FIGS. 2-5.

Figure 27:
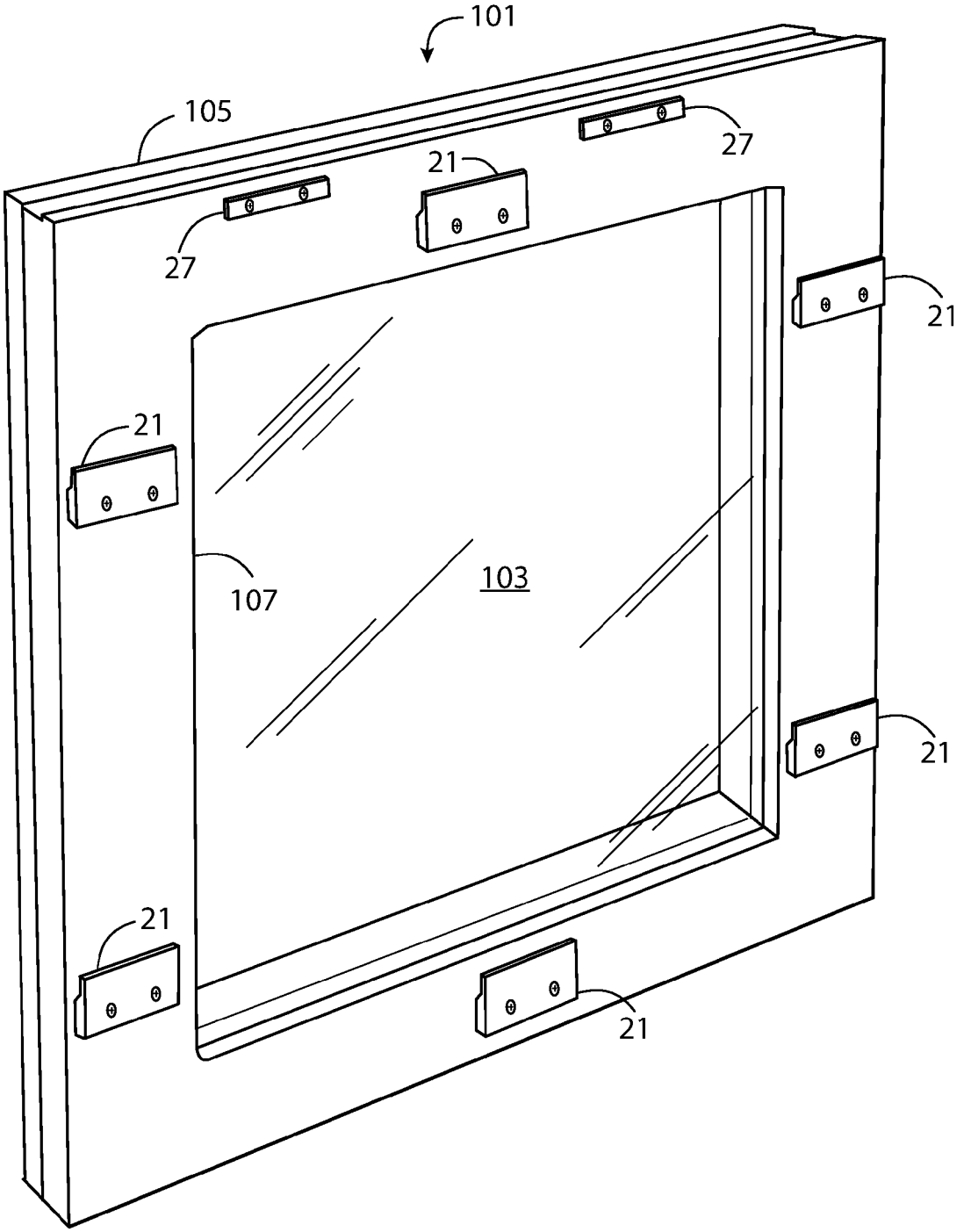
FIG. 27 illustrates the window of FIG. 24 after the cladding is removed.

The relationship between the frame-mounted retaining clip 21 and cladding-mounted retaining clip 23 is structurally similar to the relationship shown in FIGS. 2-5 and FIGS. 9-13 except, as illustrated in FIG. 27, instead of the fenestration frame header 19 in FIG. 2, is a window frame header 105, and instead of vertical fenestration frame element 29 of FIG. 4, is a side frame 107. The slot guides 27 are shown fastened and secured to the upper portion of the window frame header 105 and the frame-mounted retaining clips 21 are fastened and secured to the both the window frame header 105 and the side frame 107 of the window frame 101.

Figure 28:
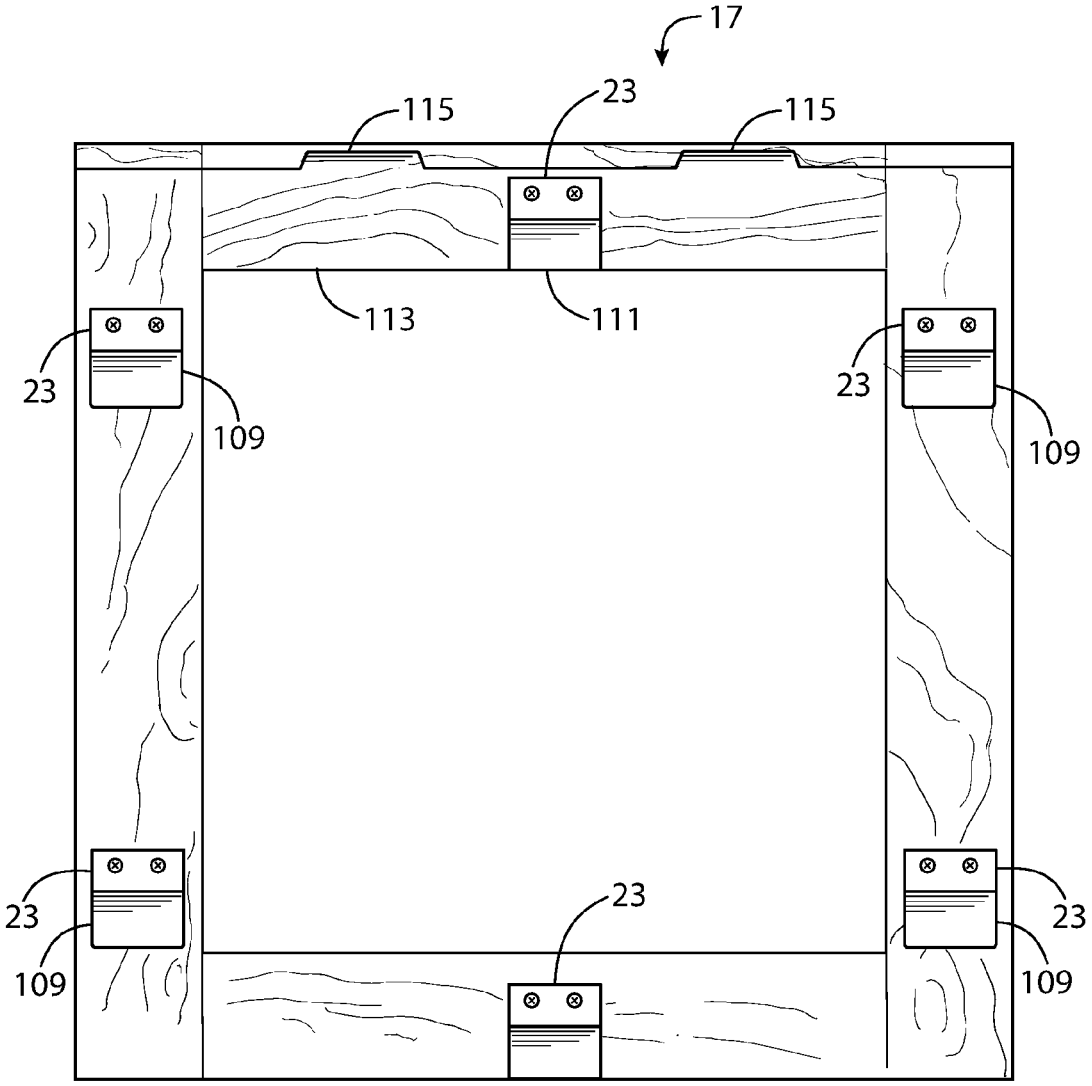
FIG. 28 illustrates the inside, or frame-facing side of the cladding of FIG. 27.

FIG. 27 illustrates the window frame 101 and glazing 103 with the removable cladding 17 removed. FIG. 28 illustrates the inside, or frame-facing side of the removable cladding 17 removed from the window frame 101 of FIG. 27. Referring to FIG. 28, the cladding-mounted retaining clip 23 and a first recess 109 in the side frame 107 below cladding-mounted retaining clip 23, and a second recess 111 below the cladding-mounted retaining clip 23 secured to the cladding header 113. The second recess 111 is shown extending down to the bottom of the cladding header 113. This allows the removable cladding 17 to lifting off of the frame-mounted retaining clips 21 of FIG. 27, more easily. The first recess 109 and the cladding-mounted retaining clips 23 on the side frame 107 are structured as described in FIGS. 9 and 10 allowing the cladding to be easily pushed up and then forward after removal of the keeper bar of FIG. 25. A set of third recesses 115 in the top of the cladding header 113 are sized and positioned to snuggly receive and hold the slot guides 27 of FIG. 27. The third recesses 115 are cut out of a top frame edge strip 117. The top frame edge strip 117 in combination with the slot guides 27 of FIG. 27 form a top guide edge for the keeper bar of FIG. 25.

Figure 29:
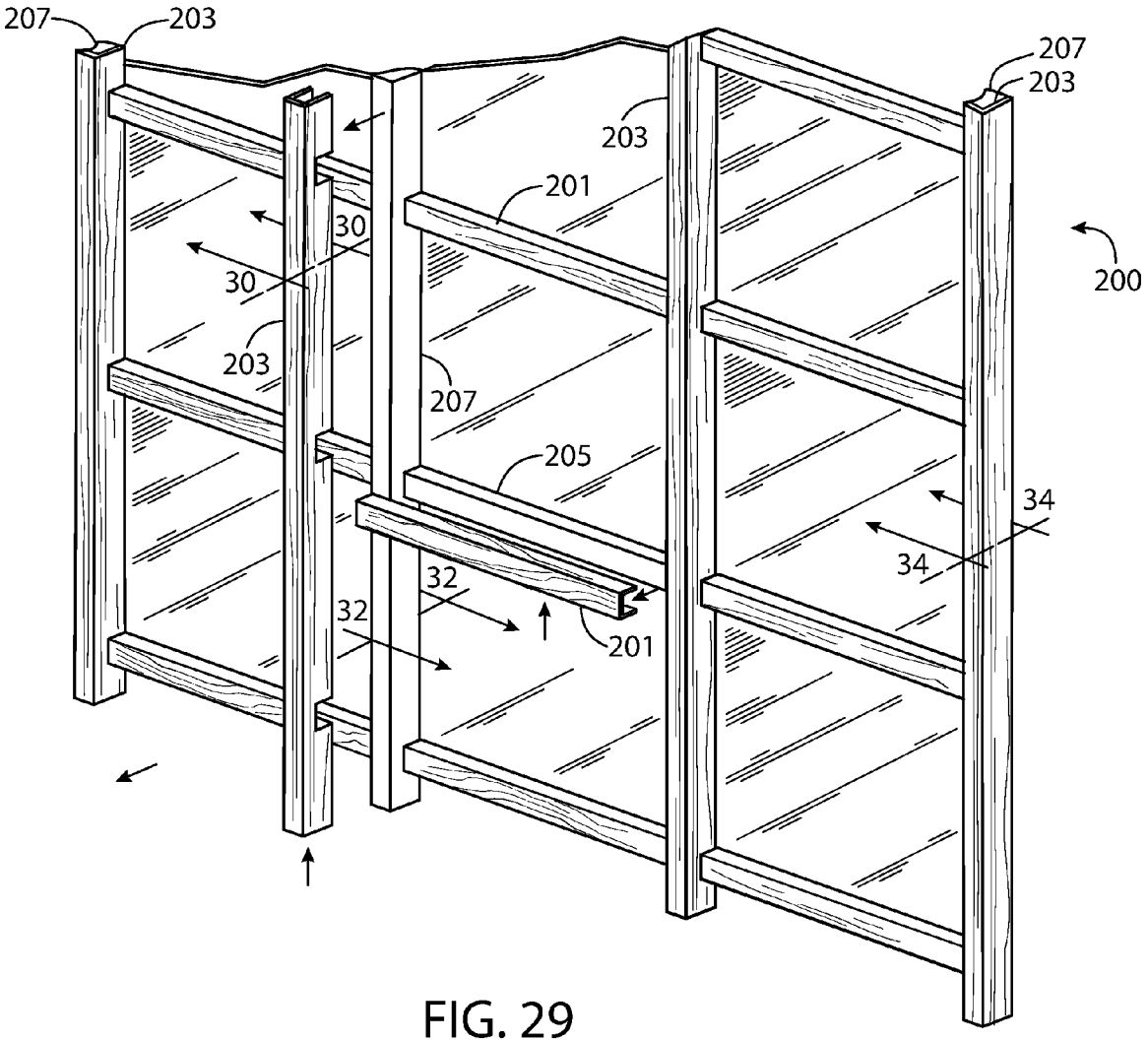
FIG. 29 illustrates a section of a curtain wall that includes a cladding system in accordance with this disclosure.

FIG. 29 illustrates a section of a curtain wall 200 that includes a cladding system in accordance with this disclosure illustrating the removable horizontal cladding 201 and the removable vertical cladding 203 over horizontal framing members 205 and vertical framing members 207 respectively. The removable horizontal cladding 201 and removable vertical cladding 203 shown are each u-shaped and made of wood. As previously described, the cladding can be made of wood, an engineered wood product, plastic, or any other material suitable as a frame cover according to architectural or aesthetic requirements. The removable horizontal cladding 201 can alternatively be L-shaped and covering the top and front of the horizontal framing members 205.

The removable horizontal cladding 201 and the removable vertical cladding 203 can be separately removable or alternatively can configured to be removable in sections. The sections of the removable horizontal cladding 201 and the removable vertical cladding 203 in FIG. 29 are each shown as being configured to be separately removable.

Figure 30:
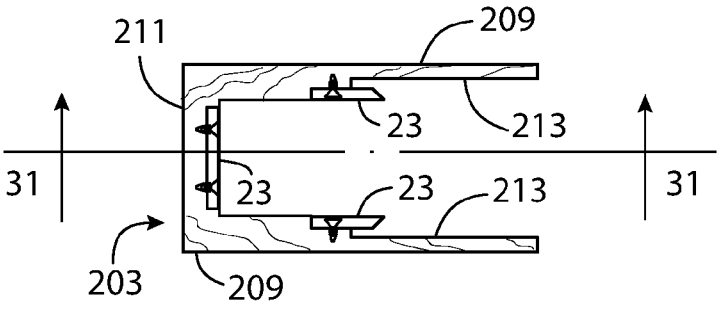
FIG. 30 illustrates a sectional view of FIG. 29, taken along section lines 30-30 of the vertical framing member and the removable vertical cladding removed from the vertical framing member.
Figure 31:
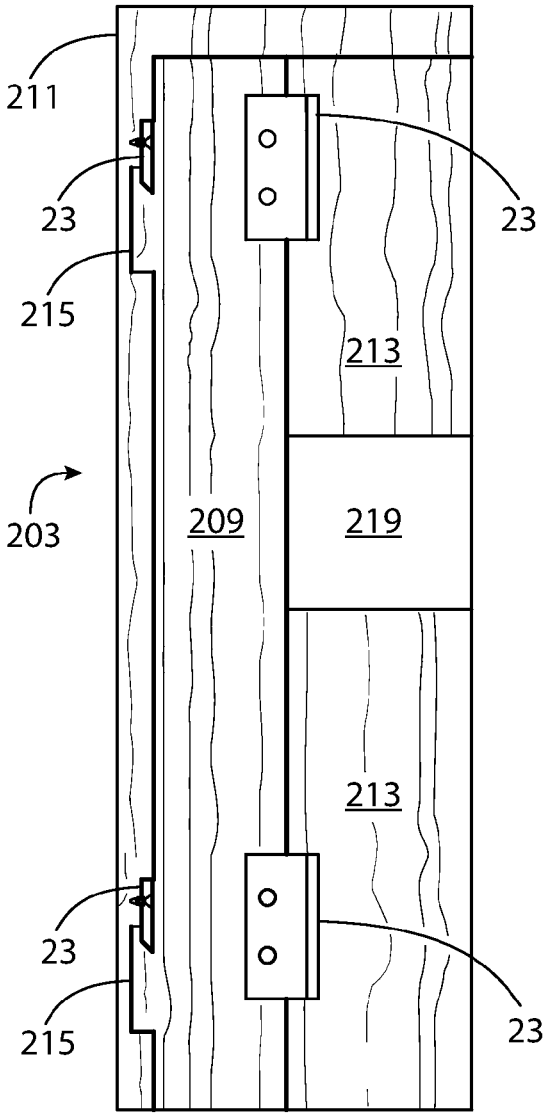
FIG. 31 illustrates a sectional view of FIG. 30, taken along lines 31-31 of the removable vertical cladding.
Figure 32:
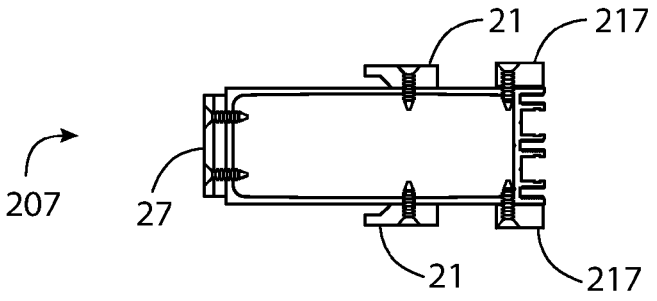
FIG. 32 illustrates a sectional view of FIG. 29, taken along section lines 32-32.
Figure 33:
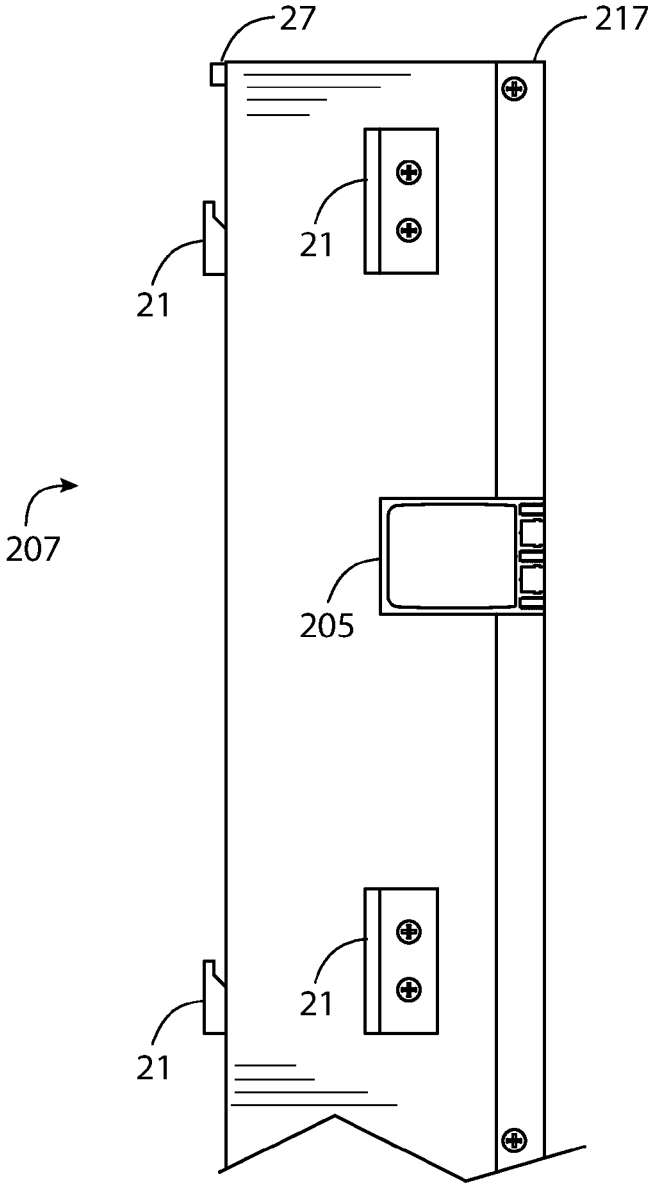
FIG. 33 illustrates a side view of a portion of the vertical framing member 207.
Figure 34:
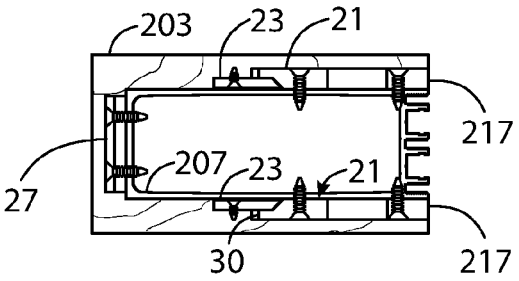
FIG. 34 illustrates a sectional view of the vertical framing member together with the removable vertical cladding of FIG. 29 taken along section lines 34-34.
Figure 35:
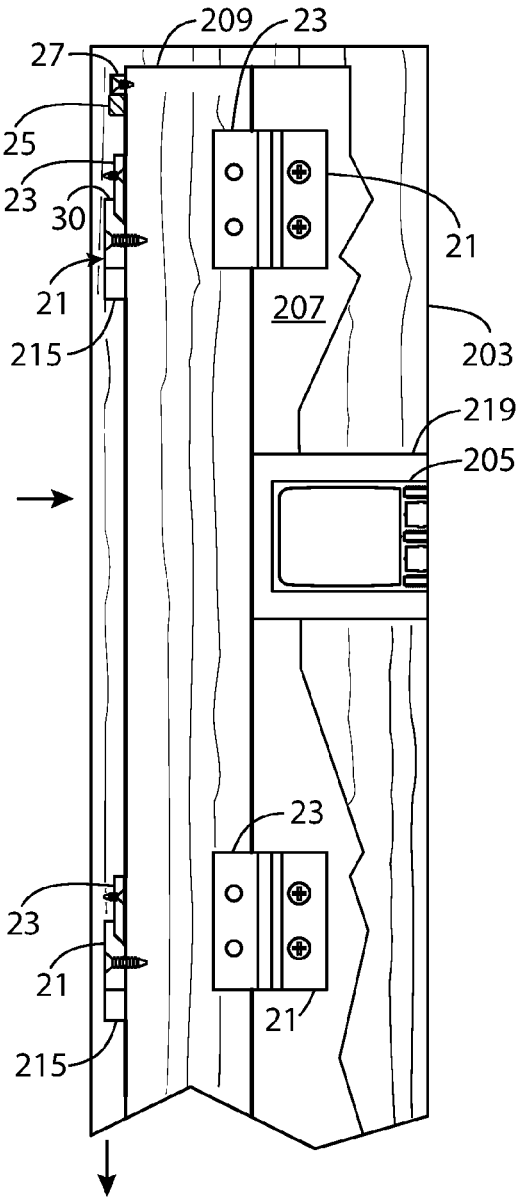
FIG. 35 is a side view in partial cutaway of a portion of the vertical framing member of FIGS. 29 and 34.

FIG. 30 illustrates a sectional view of FIG. 29, taken along section lines 30-30 of the vertical framing member 207 and the removable vertical cladding 203 removed from the vertical framing member 207. FIG. 31 illustrates a sectional view of FIG. 30, taken along section lines 31-31 of the removable vertical cladding 203. FIG. 32 illustrates a sectional view of FIG. 29, taken along section lines 32-32. FIG. 33 illustrates a side view of a portion of the vertical framing member 207. FIG. 34 illustrates a sectional view of the vertical framing member 207 together with the removable vertical cladding 203 of FIG. 29 taken along section lines 34-34. FIG. 35 is a side view in partial cutaway of a portion of the vertical framing member 207 and removable vertical cladding 203 of FIGS. 29 and 34.

Referring to FIGS. 30 and 31, the removable vertical cladding 203 includes cladding-mounted retaining clips 23 on each of the inside surfaces the vertical cladding sides 209 and on the inside surface of the vertical cladding front face 211. The vertical cladding sides 209 include a first recess 213 shown running downward most of the length of the vertical cladding sides 209, both shown in FIG. 30 and one of which is shown in FIG. 31. Referring to FIGS. 34 and 35, the cladding-mounted retaining clip 23 mounted on the vertical cladding side 209 overlaps the first recess 213, similarly as described for the second recess 35 of FIGS. 9 and 10, so that the cavity created between the first recess 213 and the cladding-mounted retaining clip 23 can receive and hold the end portion 30 of the frame-mounted retaining clip 21 in its entirety. The inside surface of the vertical cladding front face 211 includes a second recess 215 shown in FIG. 31. The second recess 215 is similar to the second recess 35 of FIGS. 9 and 10. In FIG. 31, a lower portion of the cladding-mounted retaining clip 23 is mounted over a second recess 215. The width of the second recess 215 is approximately the same width as the cladding-mounted retaining clip 23. The width of the frame-mounted retaining clip 21 in FIGS. 32 and 33 is approximately the same width as the cladding-mounted retaining clip 23. The height of the second recess 215 of FIG. 31 is at least as long as the sum of the height of the frame-mounted retaining clip 21 plus the overhang length of the cladding-mounted retaining clip 23. Referring to FIG. 35, the height of the second recess 215 allows an upward movement of the removable vertical cladding 203 to clear the top of the frame-mounted retaining clip 21 from the bottom of the cladding-mounted retaining clip 23.

Referring to FIGS. 29 and 34, a typical assembly sequence would involve installing the removable vertical cladding 203 by pushing the removable vertical cladding 203 forward toward the vertical framing member 207 and then pushing the removable vertical cladding 203 down to secure it in place. Referring to FIG. 35, optionally, the keeper bar 25 can be slid into the vertical cladding side 209 to prevent the removable vertical cladding 203 from being removed. Referring to FIG. 29, the removable horizontal cladding 201 adjacent and to the right of to the removable vertical cladding 203 that was just installed is pushed onto the horizontal framing member 205 and then slid to the left to secure it in place. The removable horizontal cladding 201 and the horizontal framing member 205 can have the same arrangement of frame-mounted retaining clips 21, cladding-mounted retaining clips 23, the first recess 213 and the second recess 215 as described for the removable vertical cladding 203 and the vertical framing member 207.

Referring to FIG. 35, the removable horizontal cladding 201 is slid into place, it slides into a vertical framing member opening 219 in a portion of the removable vertical cladding 203 that surrounds the horizontal framing member 205. The removable vertical cladding 203 immediately adjacent and to the right of the horizontal framing member 205 that was just installed is now installed by the sequence described in the preceding paragraphs. In this way, each of the removable horizontal cladding 201 and removable vertical cladding 203 can be installed. To remove the cladding from the curtain wall 200, the described sequence would be reversed.

A removable cladding system for doorframes, window frames, curtain walls, skylights, and other fenestrations has been described. It is not the intent of this disclosure to limit the claimed invention to the examples, variations, and exemplary embodiments described in the specification. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A quick-release cladding system, comprising:

a fenestration frame defining peripheral edges of an opening;

a removable cladding frame;

the removable cladding frame includes surface elements that are planarly movable against corresponding surface elements on the fenestration frame constraining the removable cladding frame to engage the fenestration frame vertically downward and then obliquely downward and inward causing inward facing surfaces of the removable cladding frame to move flush against corresponding outward facing surfaces of the fenestration frame together forming a cladded fenestration frame; and a keeper bar, separate from the fenestration frame and the removable cladding frame and including a first end surface, a second end surface, and a longitudinal horizontal surface positioned therebetween, the keeper bar removably positionable horizontally, longitudinally, and entirely between the fenestration frame and the removable cladding frame of the cladded fenestration frame with the longitudinal horizontal surface preventing upward movement of the removable cladding frame with respect to the fenestration frame when positioned therebetween.

2. The quick-release cladding system of claim 1, wherein the fenestration frame and the removable cladding frame together constrain the keeper bar to slide horizontally and longitudinally therebetween.

3. The quick-release cladding system of claim 1, wherein:

the fenestration frame includes a horizontal frame member defining a top horizontal peripheral edge of the opening;

the removable cladding frame includes a horizontal cladding member defining an upper peripheral edge of the removable cladding frame; and the keeper bar removably positionable horizontally, longitudinally, and entirely between the horizontal frame member and the horizontal cladding member of the cladded fenestration frame.

4. The quick-release cladding system of claim 1, wherein:

the opening includes a glazing member with the fenestration frame framing opposing vertical edges and a top horizontal edge of the glazing member.

5. A quick-release cladding system, comprising:

a fenestration frame defining peripheral edges of an opening and including a horizontal frame member defining a top horizontal peripheral edge of the opening, a first vertical frame member and a second vertical frame member each extending downward from opposing ends of the horizontal frame member and defining opposing vertical peripheral edges of the opening;

a removable cladding frame including a horizontal cladding member defining an upper peripheral edge of the removable cladding frame, a first vertical cladding member and a second vertical cladding member extending downward from the horizontal cladding member on opposing ends of the horizontal cladding member;

the removable cladding frame includes surface elements that are planarly movable against corresponding surface elements on the fenestration frame constraining the removable cladding frame to engage the fenestration frame vertically downward and then downward and inward at an oblique angle causing inward facing surfaces of the first vertical cladding member, the second vertical cladding member, and the horizontal cladding member to move flush against corresponding outward facing surfaces of the first vertical frame member, the second vertical frame member, and the horizontal frame member respectively together forming a cladded fenestration frame; and a keeper bar, separate from the fenestration frame and the removable cladding frame and including a first end surface, a second end surface, and a longitudinal horizontal surface positioned therebetween, the keeper bar removably positionable horizontally, longitudinally, and entirely between the fenestration frame and the removable cladding frame preventing upward movement of the removable cladding frame with respect to the fenestration frame when positioned therebetween.

6. The quick-release cladding system of claim 5, wherein the fenestration frame and the removable cladding frame together constrain the keeper bar to slide horizontally and longitudinally therebetween.

7. The quick-release cladding system of claim 5, wherein:

the opening includes a glazing member extending to horizontal frame member, the first vertical frame member, and the second vertical frame member.

8. The quick-release cladding system of claim 7 wherein:

the horizontal frame member is a top rail;

the first vertical frame member is a first stile; and the second vertical frame member is a second stile.

9. The quick-release cladding system of claim 5, wherein:

the horizontal frame member is a head jamb;

the first vertical frame member is a first side jamb; and the second vertical frame member is a second side jamb.

10. The quick-release cladding system of claim 5, wherein:

the keeper bar removably positionable horizontally, longitudinally, and entirely between the horizontal frame member and the horizontal cladding member of the cladded fenestration frame.

* * * * *